US009783963B2

(12) United States Patent
Yagita et al.

(10) Patent No.: US 9,783,963 B2
(45) Date of Patent: Oct. 10, 2017

(54) SAFETY DEVICE FOR CIRCULATING WATER UTILIZATION SYSTEM AND CIRCULATING-WATER UTILIZATION SYSTEM

(71) Applicant: MITSUBISHI HITACHI POWER SYSTEMS, LTD., Yokohama-shi, Kanagawa (JP)

(72) Inventors: Hiroyuki Yagita, Tokyo (JP); Junichi Minamiura, Tokyo (JP); Jun Hyodo, Tokyo (JP); Yukinobu Yokota, Tokyo (JP); Hayato Shin, Tokyo (JP); Riki Kitagawa, Tokyo (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 3 days.

(21) Appl. No.: 15/100,884

(22) PCT Filed: Dec. 4, 2014

(86) PCT No.: PCT/JP2014/082097
§ 371 (c)(1),
(2) Date: Jun. 1, 2016

(87) PCT Pub. No.: WO2015/083785
PCT Pub. Date: Jun. 11, 2015

(65) Prior Publication Data

US 2016/0281338 A1 Sep. 29, 2016

(30) Foreign Application Priority Data

Dec. 5, 2013 (JP) ..... 2013-251619

(51) Int. Cl.
*E03B 7/07* (2006.01)
*E03B 1/04* (2006.01)

(52) U.S. Cl.
CPC ..... *E03B 7/074* (2013.01); *E03B 1/041* (2013.01); *E03B 1/042* (2013.01); *Y10T 137/85954* (2015.04)

(58) Field of Classification Search
CPC . E03B 7/07; E03B 1/042; E03B 1/041; Y10T 137/85954
(Continued)

(56) References Cited

U.S. PATENT DOCUMENTS 6,766,822 B2 * 7/2004 Walker ..... E03B 7/04 137/365
2016/0319522 A1 * 11/2016 Sparre et al. ..... E03B 1/041

FOREIGN PATENT DOCUMENTS

JP S61-230707 A 10/1986
JP S63-119892 A 5/1988
(Continued)

OTHER PUBLICATIONS

Notification of Transmittal of Translation of the International Preliminary Report on Patentability (Form PCT/IB/338) of International Application No. PCT/JP2014/082082 dated Jun. 16, 2016, with Forms PCT/IB/373 and PCT/ISA/237. (11 pages).
(Continued)

*Primary Examiner* — Kevin Lee
(74) *Attorney, Agent, or Firm* — Westerman, Hattori, Daniels & Adrian, LLP

(57) ABSTRACT

A safety device of a recirculating-water utilization system to be constructed in a specific area includes: at least one of a circulating-water monitoring unit configured to monitor a water quality of circulating water purified by a purifying unit, or a treatment-vessel monitoring unit configured to detect abnormality of treatment vessels constituting the purifying unit.

10 Claims, 11 Drawing Sheets

(58) Field of Classification Search
USPC ..... 137/563
See application file for complete search history.

(56) References Cited

FOREIGN PATENT DOCUMENTS

| | | | |
|---|---|---|---|
| JP | H06-79142 | A | 3/1994 |
| JP | H06-210291 | A | 8/1994 |
| JP | H06-226059 | A | 8/1994 |
| JP | H06-240711 | A | 8/1994 |
| JP | H06-269766 | A | 9/1994 |
| JP | H06-277455 | A | 10/1994 |
| JP | 06-77886 | U | 11/1994 |
| JP | H07-68257 | A | 3/1995 |
| JP | 7-251186 | A | 10/1995 |
| JP | 08-19773 | A | 1/1996 |
| JP | H08-229590 | A | 9/1996 |
| JP | H09-296593 | A | 11/1997 |
| JP | H10-33953 | A | 2/1998 |
| JP | H10-57941 | A | 3/1998 |
| JP | 10-286033 | A | 10/1998 |
| JP | 11-090464 | A | 4/1999 |
| JP | H11-114551 | A | 4/1999 |
| JP | H11-207155 | A | 8/1999 |
| JP | H11-220155 | A | 8/1999 |
| JP | 2000-288570 | A | 10/2000 |
| JP | 2001-170458 | A | 6/2001 |
| JP | 2002-045872 | A | 2/2002 |
| JP | 2002-166263 | A | 6/2002 |
| JP | 2002-210335 | A | 7/2002 |
| JP | 2002-215731 | A | 8/2002 |
| JP | 2002-267657 | A | 9/2002 |
| JP | 2002-316143 | A | 10/2002 |
| JP | 2003-019491 | A | 1/2003 |
| JP | 2003-075209 | A | 3/2003 |
| JP | 2003-088891 | A | 3/2003 |
| JP | 2003-178155 | A | 6/2003 |
| JP | 2003-519552 | A | 6/2003 |
| JP | 2004-008958 | A | 1/2004 |
| JP | 2004-038902 | A | 2/2004 |
| JP | 2004-041887 | A | 2/2004 |
| JP | 2004-141846 | A | 5/2004 |
| JP | 2004-249174 | A | 9/2004 |
| JP | 2004-290719 | A | 10/2004 |
| JP | 2005-149003 | A | 6/2005 |
| JP | 2005-186960 | A | 7/2005 |
| JP | 2006-051477 | A | 2/2006 |
| JP | 2006-223935 | A | 8/2006 |
| JP | 2006-233779 | A | 9/2006 |
| JP | 2006-281074 | A | 10/2006 |
| JP | 2006-281159 | A | 10/2006 |
| JP | 06-302049 | A | 11/2006 |
| JP | 2006-302049 | A | 11/2006 |
| JP | 2006-305499 | A | 11/2006 |
| JP | 2006-310209 | A | 11/2006 |
| JP | 2007-185648 | A | 7/2007 |
| JP | 2008-307503 | A | 12/2008 |
| JP | 2009-073763 | A | 4/2009 |
| JP | 2009-124800 | A | 6/2009 |
| JP | 2009-153784 | A | 7/2009 |
| JP | 2010-120015 | A | 6/2010 |
| JP | 2010-188344 | A | 9/2010 |
| JP | 2010-253355 | A | 11/2010 |
| JP | 2010-538823 | A | 12/2010 |
| JP | 4611120 | B2 | 1/2011 |
| JP | 2011-078979 | A | 4/2011 |
| JP | 2011-152544 | A | 8/2011 |
| JP | 2011-189253 | A | 9/2011 |
| JP | 2012-092579 | A | 5/2012 |
| JP | 2012-106198 | A | 6/2012 |
| JP | 5116986 | B2 | 1/2013 |
| JP | 2013-034926 | A | 2/2013 |
| JP | 2013-043153 | A | 3/2013 |
| JP | 2013-188710 | A | 9/2013 |
| WO | 2013/176119 | A1 | 11/2013 |

OTHER PUBLICATIONS

International Search Report dated Jan. 13, 2015, issued in counterpart International Application No. PCT/JP2014/082082. (8 pages).
Decision to Grant a Patent dated May 7, 2014, issued in counterpart Japanese Patent Application No. 2013-251625, with English translation. (6 pages).
Office Action dated Feb. 12, 2014, issued in counterpart Japanese Patent Application No. 2013-251630, with English translation. (7 pages).
Decision to Grant a Patent dated May 7, 2014, issued in counterpart Japanese Patent Application No. 2013-251630, with English translation. (6 pages).
International Search Report dated Jan. 13, 2015, issued in counterpart International Application No. PCT/JP2014/082079. (8 pages).
Notification of Transmittal of Translation of the International Preliminary Report on Patentability (Form PCT/IB/338) of International Application No. PCT/JP2014/082079 dated Jun. 16, 2016, with Forms PCT/IB/373 and PCT/ISA/237. (13 pages).
Decision to Grant a Patent dated Mar. 4, 2014, issued in counterpart Japanese Patent Application No. 2013-251627, with English translation. (6 pages).
International Search Report dated Jan. 13, 2015, issued in counterpart International Application No. PCT/JP2014/082080. (7 pages).
Notification of Transmittal of Translation of the International Preliminary Report on Patentability (Form PCT/IB/338) of International Application No. PCT/JP2014/082080 dated Jun. 16, 2016, with Forms PCT/IB/373 and PCT/ISA/237. (11 pages).
Decision to Grant a Patent dated May 23, 2014, issued in counterpart Japanese Patent Application No. 2013-251626, with English translation. (6 pages).
International Search Report dated Jan. 13, 2015, issued in counterpart International Application No. PCT/JP2014/082081. (9 pages).
Notification of Transmittal of Translation of the International Preliminary Report on Patentability (Form PCT/IB/333) of International Application No. PCT/JP2014/082081 dated Jun. 16, 2016, with Forms PCT/IB/373 and PCT/ISA/237. (15 pages).
International Search Report dated Jan. 13, 2015, issued in counterpart International Application No. PCT/JP2014/082083 (7 pages).
Notification of Transmittal of Translation of the International Preliminary Report on Patentability (Form PCT/IB/338) of International Application No. PCT/JP2014/082083 dated Jun. 16, 2016, with Forms PCT/IB/373 and PCT/ISA/237. (11 pages).
Decision to Grant a Patent dated Feb. 25, 2014, issued in counterpart Japanese Patent Application No. 2013-251624, with English translation. (6 pages).
International Search Report dated Jan. 20, 2015, issued in counterpart International Application No. PCT/JP2014/082093 (7 pages).
Notification of Transmittal of Translation of the International Preliminary Report on Patentability (Form PCT/IB/338) of International Application No. PCT/JP2014/082093 dated Jun. 16, 2016, with Forms PCT/IB/373 and PCT/ISA/237. (11 pages).
Decision to Grant a Patent dated Mar. 4, 2014, issued in counterpart Japanese Patent Application No. 2013-251623, with English translation. (6 pages).
International Search Report dated Feb. 24, 2015, issued in International App. No. PCT/JP2014/082095. (12 pages).
Notification of Transmittal of Translation of the International Preliminary Report on Patentability (Form PCT/IB/338) of International Application No. PCT/JP2014/082095 dated Jun. 16, 2016, with Forms PCT/IB/373 and PCT/ISA/237. (22 pages).
Decision to Grant a Patent dated Aug. 1, 2014, issued in counterpart Japanese Patent Application No. 2013-251629, with English translation. (6 pages).
International Search Report dated Sep. 10, 2013, issued in International App. No. PCT/JP2013/063920. (7 pages).
Notification of Transmittal of Translation of the International Preliminary Report on Patentability (Form PCT/IB/338) of International Application No. PCT/JP2013/068920 dated Sep. 10, 2013, with Forms PGT/IB/373 and PCT/ISA/237. (10 pages).
Decision to Grant a Patent dated Aug. 12, 2013, issued in counterpart Japanese Patent Application No. 2013-143842, with English translation, (6 pages).

(56) References Cited

OTHER PUBLICATIONS

International Search Report dated Sep. 10, 2013, issued in International App. No. PCT/JP2013/068923. (7 pages).
Notification of Transmittal of Translation of the International Preliminary Report on Patentability (Form PCT/IB/338) of International Application No. PCT/JP2013/063923 dated Jan. 12, 2016, with Forms PCT/IB/373 and PCT/ISA/237. (10 pages).
Decision to Grant a Patent dated Aug. 12, 2013, issued in counterpart Japanese Patent Application No. 2013-143843, with English translation. (6 pages).
"Ministry of the Environment", Manual for Industrial Wastewater Treatment Technology Transfer 2002, Mar. 2003, with a concise explanation of the relevance. (133 pages).
Japan Patent Office, Hyojun Gijutsushu (Mizu Shori Gijutsu), May 12, 2006, pp. 94-95.
Notification of Transmittal of Translation of the International Preliminary Report on Patentability (Form PCT/IB/338) of International Application No. PCT/JP2014/082078 dated Jun. 16, 2016, with Forms PCT/IS/373 and PCT/ISA/237. (11 pages).
International Search Report dated Feb. 10, 2015, issued in International App. No. PCT/JP2014/082078. (8 pages).
Decision to Grant a Patent dated Mar. 4, 2014, issued in counterpart Japanese Patent Application No. 2013-251628, with English translation. (6 pages).
Notice of Allowance dated Nov. 23, 2016, issued in related U.S. Appl. No. 15/100,849 (9 pages).
International Search Report dated Jan. 20, 2015, issued in counterpart International Application No. PCT/JP2014/082094, with partial translation. (8 pages). (U.S. Appl. No. 15/037,601).
Office Action dated Mar. 4, 2014, issued in counterpart Japanese Patent Application No. 2013-251621, with English translation. (5 pages), (U.S. Appl. No. 15/100,849).
International Search Report dated Jan. 27, 2015, issued in International Patent Application No. PCT/JP2014/082096. (9 pages), (U.S. Appl. No. 15/100,849).
Notification of Transmittal of Translation of the International Preliminary Report on Patentability (Form PCT/IB/338) of International Application No. PCT/JP2014/082096 dated Jun. 16, 2016, with Forms PCT/IB/373 and PCT/ISA/237. (13 pages) (U.S. Appl. No. 15/100,849).
Translation of Notification of Transmittal of Translation of the International Preliminary Report on Patentability (Form PCT/IB/338) of International Application No. PCT/JP2014/082097 dated Jun. 16, 2016, with Forms PCT/IB/373 and PCT/ISA/237. (15 pages), (U.S. Appl. No. 15/100,884).
International Search Report dated Feb. 10 2015, issued in International Patent Application No. PCT/JP2014/082098. (7 pages).
Notice of Allowance of counterpart Japanese Application No. 2013-251619, dated May 16, 2014, with English translation. (6 pages). (U.S. Appl. No. 15/100,884).
Notice of Allowance of counterpart Japanese Application No. 2013-251620, dated Mar. 4, 2016, with English translation. (6 pages).
Notice of Allowance of counterpart Japanese Application No. 2013-251621, dated Feb. 25, 2014, with English translation. (6 pages). (U.S. Appl. No. 15/100,849).
Translation of Notification of Transmittal of Translation of the International Preliminary Report on Patentability (Form PCT/IB/338) of International Application No. PCT/JP2014/082094, dated Jun. 16, 2016, with Forms PCT/IB/373 and PCT/ISA/237. (11 pages). (U.S. Appl. No. 15/037,601).
Notice of Allowance of counterpart Japanese Application No. 2013-251622, dated May 23, 2014, with English translation. (6 pages). (U.S. Appl. No. 15/037,601).
Translation of Notification of Transmittal of Translation of the International Preliminary Report on Patentability (Form PCT/IB/338) of International Application No. PCT/JP2014/082098 dated Jun. 16, 2016, with Forms PCT/IB/373 and PCT/ISA/237. (11 pages).
International Search Report dated Feb. 10, 2015, issued in International Patent Application No. PCT/JP2014/082097. (8 pages). (U.S. Appl. No. 15/100,884).
Notice of Allowance of counterpart Japanese Application No. 2013-251620, dated Feb. 25, 2016, with English translation. (6 pages) (U.S. Appl. No. 15/100,865).
Notice of Allowance of counterpart Japanese Application No. 2013-251621, dated May 23, 2014, with English translation. (6 pages). (U.S. Appl. No. 15/100,849).
Notice of Allowance of counterpart Japanese Application No. 2013-251622, dated Mar. 24, 2014, with English translation. (6 pages). (U.S. Appl. No. 15/037,601).

* cited by examiner

FIG. 2

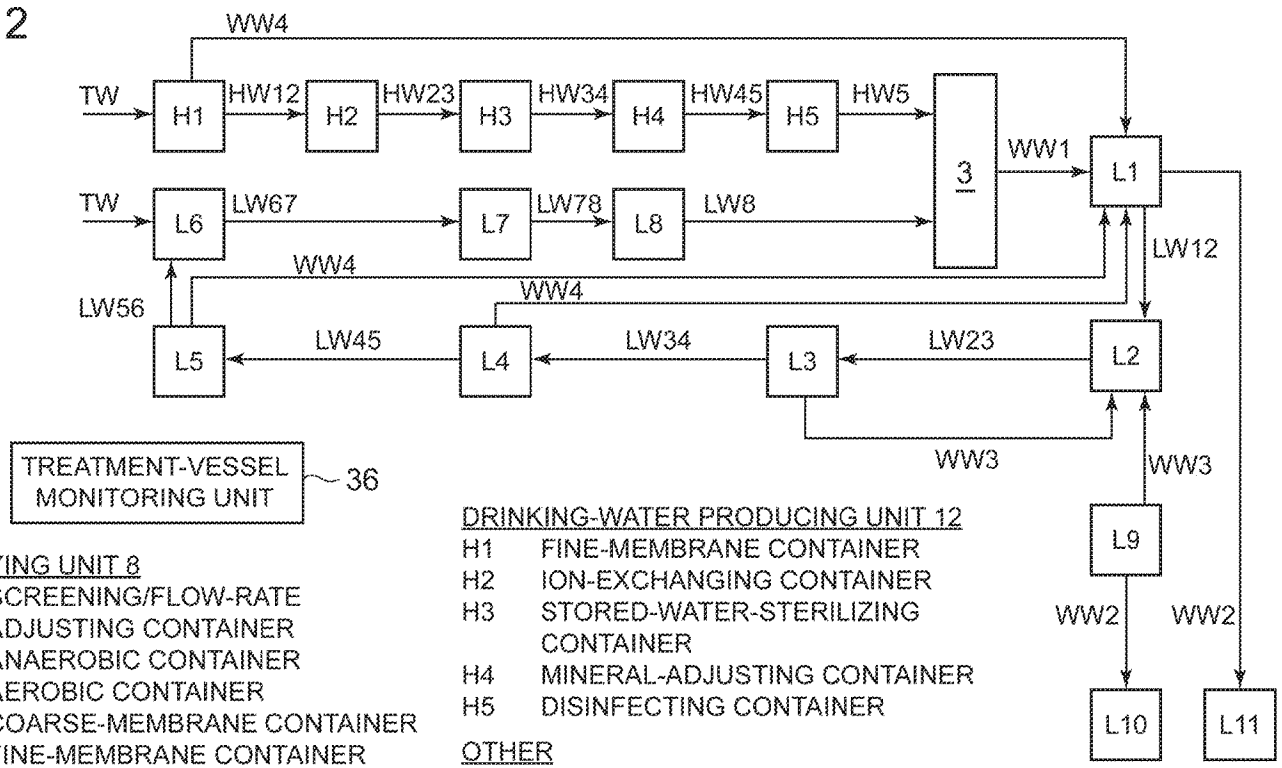

PURIFYING UNIT 8

L1 SCREENING/FLOW-RATE ADJUSTING CONTAINER
L2 ANAEROBIC CONTAINER
L3 AEROBIC CONTAINER
L4 COARSE-MEMBRANE CONTAINER
L5 FINE-MEMBRANE CONTAINER
L6 OZONIZING CONTAINER
L7 STORED-WATER-STERILIZING CONTAINER
L8 DISINFECTING CONTAINER
L9 SLUDGE RETURNING/DEWATERING CONTAINER
L10 SLUDGE-STORING CONTAINER

DRINKING-WATER PRODUCING UNIT 12

H1 FINE-MEMBRANE CONTAINER
H2 ION-EXCHANGING CONTAINER
H3 STORED-WATER-STERILIZING CONTAINER
H4 MINERAL-ADJUSTING CONTAINER
H5 DISINFECTING CONTAINER

OTHER

TW** TAP WATER
HW** DRINKING WATER
LW** CIRCULATING WATER
WW1 DISCHARGE WATER
WW2 DEPOSITION/EXCESS SLUDGE
WW3 CIRCULATION RETURN/SEPARATION WATER
WW4 CONCENTRATED WATER

FIG. 5

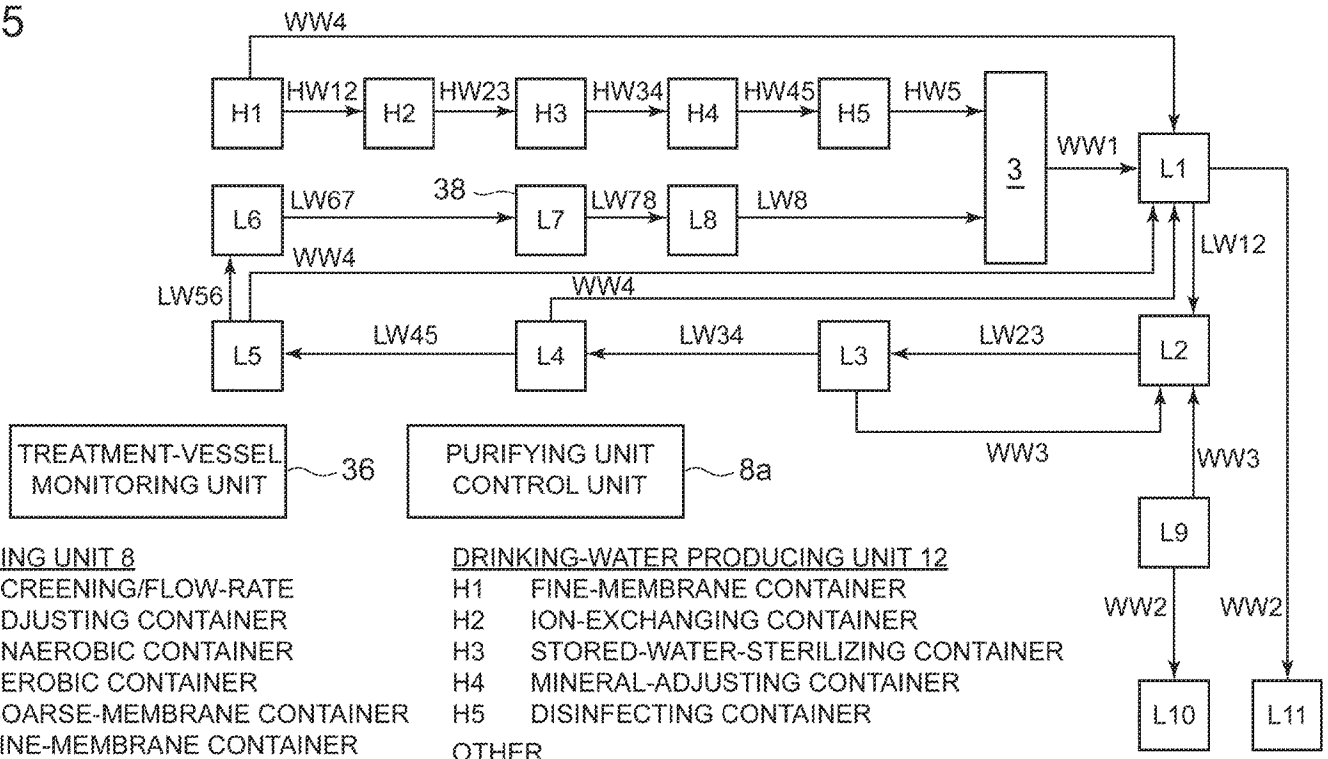

PURIFYING UNIT 8

L1 SCREENING/FLOW-RATE ADJUSTING CONTAINER
L2 ANAEROBIC CONTAINER
L3 AEROBIC CONTAINER
L4 COARSE-MEMBRANE CONTAINER
L5 FINE-MEMBRANE CONTAINER
L6 OZONIZING CONTAINER
L7 STORED-WATER-STERILIZING CONTAINER
L8 DISINFECTING CONTAINER
L9 SLUDGE RETURNING/DEWATERING CONTAINER
L10 SLUDGE-STORING CONTAINER

DRINKING-WATER PRODUCING UNIT 12

H1 FINE-MEMBRANE CONTAINER
H2 ION-EXCHANGING CONTAINER
H3 STORED-WATER-STERILIZING CONTAINER
H4 MINERAL-ADJUSTING CONTAINER
H5 DISINFECTING CONTAINER

OTHER

TW** TAP WATER
HW** DRINKING WATER
LW** CIRCULATING WATER
WW1 DISCHARGE WATER
WW2 DEPOSITION/EXCESS SLUDGE
WW3 CIRCULATION RETURN/SEPARATION WATER
WW4 CONCENTRATED WATER

FIG. 8

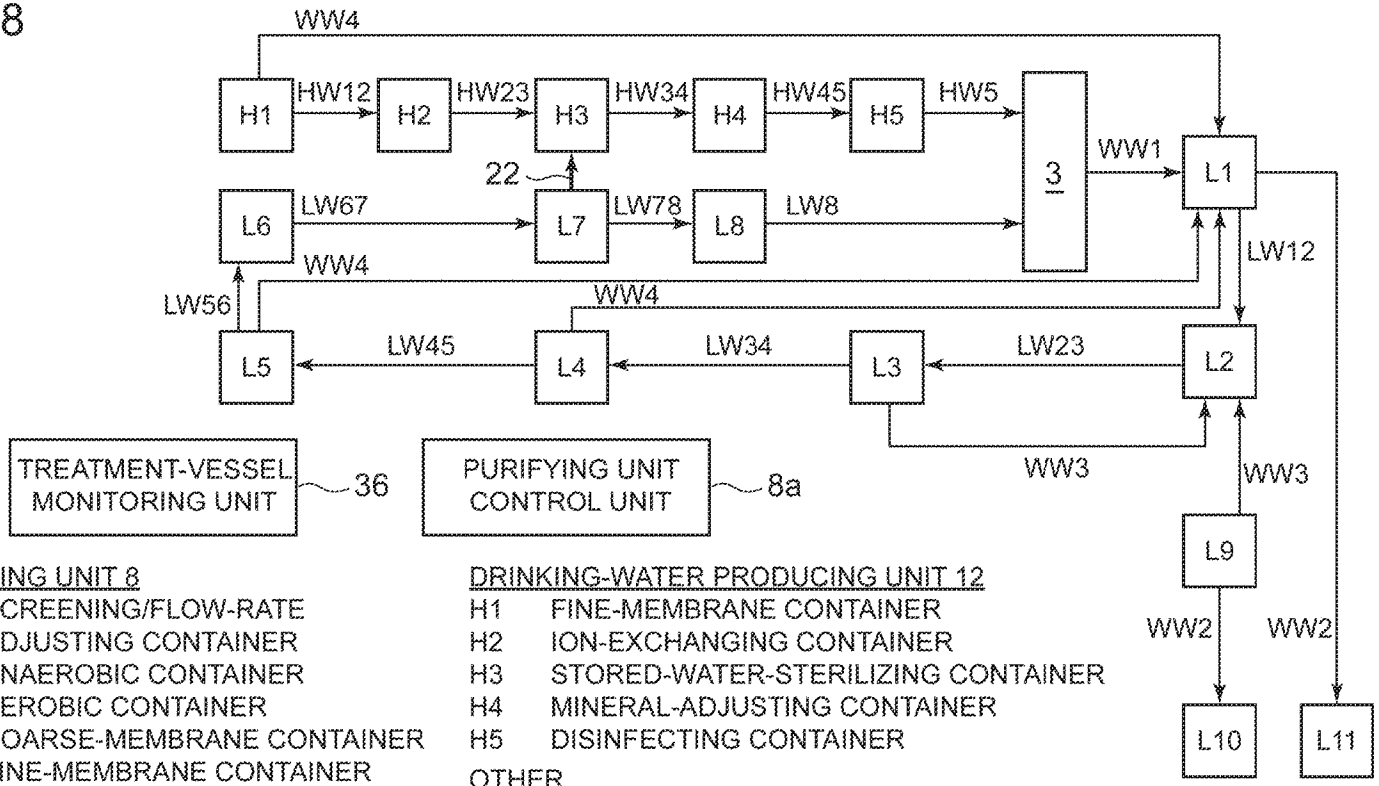

PURIFYING UNIT 8

L1 SCREENING/FLOW-RATE ADJUSTING CONTAINER
L2 ANAEROBIC CONTAINER
L3 AEROBIC CONTAINER
L4 COARSE-MEMBRANE CONTAINER
L5 FINE-MEMBRANE CONTAINER
L6 OZONIZING CONTAINER
L7 STORED-WATER-STERILIZING CONTAINER
L8 DISINFECTING CONTAINER
L9 SLUDGE RETURNING/DEWATERING CONTAINER
L10 SLUDGE-STORING CONTAINER

DRINKING-WATER PRODUCING UNIT 12

H1 FINE-MEMBRANE CONTAINER
H2 ION-EXCHANGING CONTAINER
H3 STORED-WATER-STERILIZING CONTAINER
H4 MINERAL-ADJUSTING CONTAINER
H5 DISINFECTING CONTAINER

OTHER

TW** TAP WATER
HW** DRINKING WATER
LW** CIRCULATING WATER
WW1 DISCHARGE WATER
WW2 DEPOSITION/EXCESS SLUDGE
WW3 CIRCULATION RETURN/SEPARATION WATER
WW4 CONCENTRATED WATER

FIG. 11

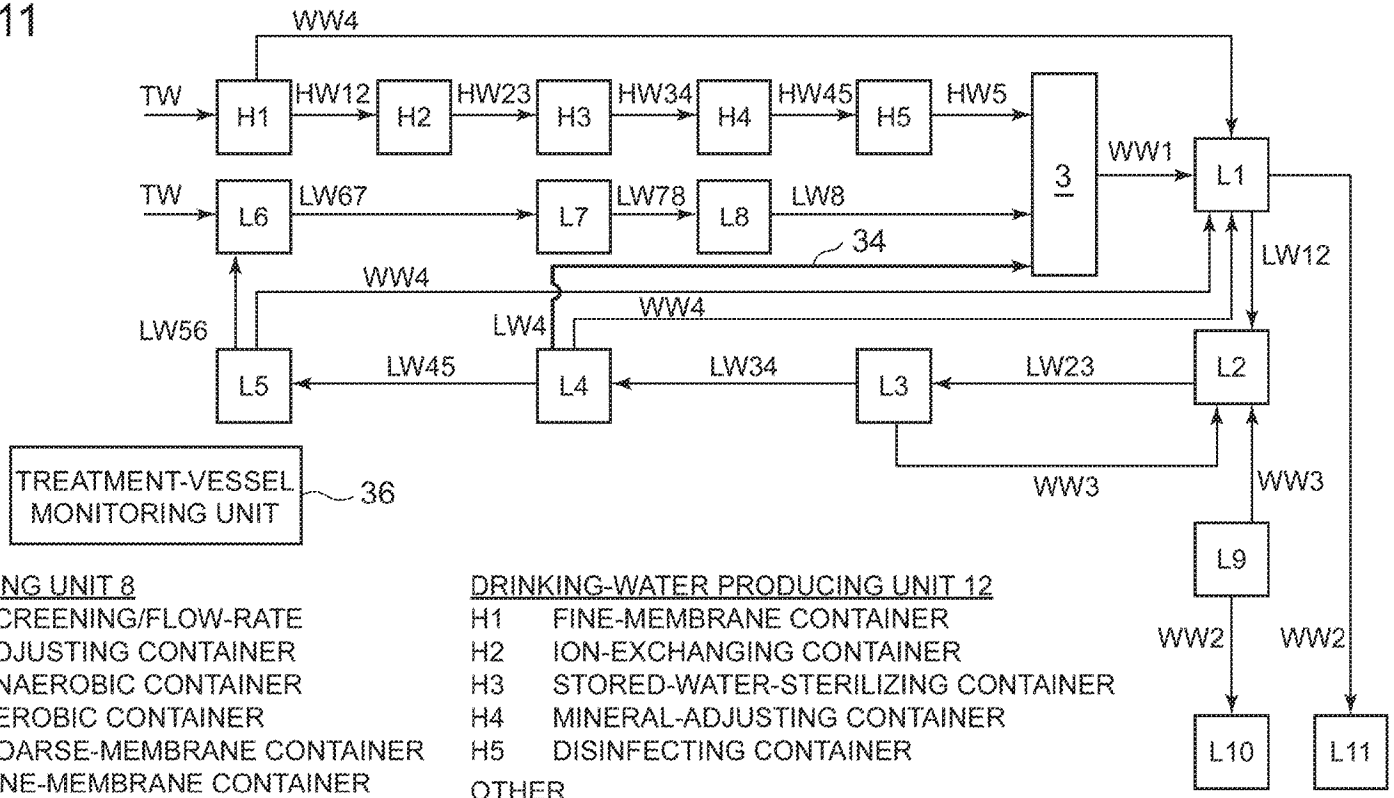

PURIFYING UNIT 8

L1 SCREENING/FLOW-RATE ADJUSTING CONTAINER
L2 ANAEROBIC CONTAINER
L3 AEROBIC CONTAINER
L4 COARSE-MEMBRANE CONTAINER
L5 FINE-MEMBRANE CONTAINER
L6 OZONIZING CONTAINER
L7 STORED-WATER-STERILIZING CONTAINER
L8 DISINFECTING CONTAINER
L9 SLUDGE RETURNING/DEWATERING CONTAINER
L10 SLUDGE-STORING CONTAINER

DRINKING-WATER PRODUCING UNIT 12

H1 FINE-MEMBRANE CONTAINER
H2 ION-EXCHANGING CONTAINER
H3 STORED-WATER-STERILIZING CONTAINER
H4 MINERAL-ADJUSTING CONTAINER
H5 DISINFECTING CONTAINER

OTHER

TW** TAP WATER
HW** DRINKING WATER
LW** CIRCULATING WATER
WW1 DISCHARGE WATER
WW2 DEPOSITION/EXCESS SLUDGE
WW3 CIRCULATION RETURN/SEPARATION WATER
WW4 CONCENTRATED WATER

SAFETY DEVICE FOR CIRCULATING WATER UTILIZATION SYSTEM AND CIRCULATING-WATER UTILIZATION SYSTEM

TECHNICAL FIELD

The present disclosure relates to a safety device for a circulating-water utilization system to be constructed in a specific area separately from a public waterworks system.

BACKGROUND ART

To make the most of limited water resources, a system for purifying and re-utilizing wastewater discharged from buildings, residences, and the like has been known. For instance, Patent Document 1 discloses a wastewater re-utilizing system configured to use drainage of clean water used in a household or the like and rainwater for flushing toilets to save water. Further, Patent Document 2 discloses an interior greening system for utilizing gray water, which produces gray water by treating wastewater in a building and re-utilizes the produced gray water for watering plants that grow inside a building.

CITATION LIST

Patent Literature

Patent Document 1: JPH8-19773A
Patent Document 2: JPH10-286033A

SUMMARY

Problems to be Solved

Meanwhile, the applicant is developing a novel circulating-water utilization system having a totally different scale from that of the above described typical re-utilization systems.

The above described typical re-utilization system is fundamentally intended to purify wastewater of clean water supplied by a waterworks system to utilize the wastewater as gray water for a specific usage, and the used gray water is discharged to a sewer system. In other words, the typical systems require the existing public waterworks system and sewer system as a premise, and cannot replace the existing systems.

In contrast, the novel circulating-water utilization system being developed by the applicant is, as described in detail below, a system that provides a service to process clean water and sewerage integrally for an area or a complex inhabited by as many as ten thousands people. In the area or complex, water is supplied and processed in circulation. In other words, this circulating-water utilization system is intended to be supplied with water from a waterworks system only for drink, but is fundamentally provided as a small distributed system of processing clean water and sewage integrally, constructed independently from existing waterworks systems and sewerage systems.

In development of such a novel circulating-water utilization system, approaches have been sought regarding how to achieve stable supply of circulating water in case abnormality or the like occurs in a purify unit of the circulating-water utilization system.

At least one embodiment of the present invention was made in view of the above typical problem, and an object of the at least one embodiment is to provide a safety device for supplying circulating water stably even if there is abnormality or the like in a purify unit, with regard to development of a novel circulating-water utilization system.

Solution to the Problems

At least one embodiment of the present invention is a safety device for a circulating-water utilization system which at least comprises: a circulation channel through which circulating water flows; a discharge channel through which wastewater discharged from a water consumer is discharged to the circulation channel, the water consumer being composed of a plurality of water consuming members including at least one of a residence, a tenant shop, or an office which uses the circulating water flowing through the circulation channel; a purifying unit configured to purify the circulating water containing the wastewater flowing through the circulation channel, the purifying unit comprising a plurality of treatment vessels connected to one another; a supply channel configured to supply the circulating water purified by the purifying unit to the water consumer; and a safety device which controls supply of the circulating water by the circulating-water utilization system. The safety device comprises at least one of a circulating-water monitoring unit configured to monitor a water quality of the circulating water purified by the purifying unit, or a treatment-vessel monitoring unit configured to detect abnormality of the treatment vessels constituting the purifying unit.

The above safety device of the circulating-water utilization system includes at least one of a circulating-water monitoring unit which monitors water quality of circulating water purified by the purifying unit or a treatment-vessel monitoring unit which detects abnormality of treatment vessels constituting the purifying unit. Thus, it is possible to detect abnormality of the purifying unit instantly.

In some embodiments, the safety device further includes: a circulating-water shutoff valve disposed in the supply channel and configured to be capable of shutting off supply of the circulating water purified by the purifying unit to the water consumer; and a circulating-water shutoff valve control unit capable of controlling operation of the circulating-water shutoff valve. The circulating-water shutoff valve control unit is configured to start operation of the circulating-water shutoff valve to shut off supply of the circulating water to the water consumer, if the circulating-water monitoring unit detects deterioration of the water quality of the circulating water purified by the purifying unit to below a predetermined water quality.

According to this embodiment, supply of circulating water to the water consumer is shut off if the circulating-water monitoring unit detects deterioration of the water quality of circulating water to below a predetermined water quality, and thereby it is possible to prevent circulating water with a deteriorated water quality from being supplied to the water consumer.

In the above embodiment, the circulating-water utilization system further includes an abnormality-time supply channel connecting a waterworks system and the supply channel at a downstream side of the circulating-water shutoff valve. The safety device further includes a gate valve disposed in the abnormality-time supply channel and configured to open and close the abnormality-time supply channel, and a gate-valve control unit capable of controlling the gate valve to open and close. The circulating-water shutoff valve control unit is configured to start operation of the circulating-water shutoff valve to shut off supply of the circulating water to the water consumer, and the gate-valve control unit is configured to open the gate valve to supply the supply channel with tap water from the waterworks system, if the circulating-water monitoring unit detects deterioration of the water quality of the circulating water purified by the purifying unit to below a predetermined water quality.

According to this embodiment, supply of circulating water to the water consumer is shut off and tap water is supplied to the water consumer as daily life water instead of circulating water, if the circulating-water monitoring unit detects deterioration of the water quality of circulating water to below a predetermined water quality. Thus, it is possible to supply daily life water stably to the water consumer even if the water quality of circulating water deteriorates.

In the above embodiment, the safety device further comprises a wastewater monitoring unit configured to monitor a water quality of the wastewater flowing through the discharge channel, and a plurality of wastewater storage tanks each of which is capable of storing a predetermined amount of the wastewater discharged from corresponding one of the plurality of water consuming members constituting the water consumer. The circulating-water shutoff valve control unit is configured to start operation of the circulating-water shutoff valve to shut off supply of the circulating water to the water consumer, and the gate-valve control unit is configured to open the gate valve to supply the supply channel with tap water from the waterworks system, if the wastewater monitoring unit detects contamination of the wastewater flowing through the discharge channel with a predetermined amount or more of a predetermined harmful substance.

According to this embodiment, supply of circulating water to the water consumer is shut off and tap water is supplied to the water consumer as daily life water instead of circulating water, if the wastewater monitoring unit detects contamination of wastewater flowing through the discharge channel with a predetermined amount or more of a predetermined harmful substance. Thus, it is possible to avoid circulating water containing a harmful substance from being supplied to the water consumer.

Further, the safety device of the present embodiment further includes a plurality of wastewater storage tanks each of which is capable of storing a predetermined amount of the wastewater discharged from corresponding one of the plurality of water consuming members constituting the water consumer. Thus, water quality of wastewater stored in the plurality of wastewater storage tanks is checked if the wastewater monitoring unit detects contamination of wastewater flowing through the discharge channel with a predetermined amount or more of a harmful substance, and thereby it is possible to specify an emission source of a harmful substance at an early stage.

In some embodiments, the purifying unit comprises a plurality of treatment-vessel rows of the plurality of treatment vessels connected in series, each of the treatment vessels comprising a container which houses a treatment device configured to perform a treatment step which constitutes a series of purifying step for purifying the wastewater. The safety device includes a switching unit capable of switching a flow of the circulating water so that the circulating water containing the wastewater flows through an optional treatment-vessel row of the plurality of treatment-vessel rows, and a switching-unit control unit capable of controlling the switching unit. The switching-unit control unit is configured to control the switching unit so that the circulating water does not flow through the treatment-vessel row including the treatment vessel in which abnormality is detected, if the treatment-vessel monitoring unit detects abnormality of the treatment vessel.

According to this embodiment, if the treatment-vessel monitoring unit detects abnormality of a treatment vessel, the switching unit is controlled so that circulating water does not flow to the treatment-vessel row including the treatment vessel in which abnormality is detected, and thus it is possible to prevent deterioration of water quality of circulating water in advance. Further, the switching unit switches a flow of circulating water, and thereby it is possible to perform repair and maintenance quickly on the treatment vessel in which abnormality is detected.

In the above embodiment, the circulating-water utilization system further includes a circulating-water storage tank capable of storing the circulating water purified by the purifying unit.

According to this embodiment, it is possible to address shortage of circulating water to be supplied to the water consumer by supplying circulating water stored in the circulating-water storage tank to the water consumer, even if the water quality of the circulating water deteriorates or even if the purifying ability of the purifying unit decreases temporarily due to abnormality of a treatment vessel.

In some embodiments, the circulating-water utilization system further includes a drinking-water producing unit configured to produce drinking water for the water consumer by purifying tap water taken in from a waterworks system, and a purified-water supply channel for supplying the drinking-water producing unit with the circulating water purified by the purifying unit, the purified-water supply channel connecting the circulation channel and the drinking-water producing unit. The safety device further includes a second gate valve configured to open and close the purified-water supply channel, an outage detecting unit capable of detecting outage of the waterworks system, and a second gate-valve control unit configured to control the second gate valve to open and close. The second gate-valve control unit is configured to open the second-gate valve to supply the drinking-water producing unit with the circulating water purified by the purifying unit, if the outage detecting unit detects outage of the waterworks system.

According to this embodiment, if the outage detecting unit detects outage of a waterworks system, the second gate-valve control unit opens the second gate valve to supply circulating water purified by the purifying unit to the drinking-water producing unit. Thus, even in the event of water outage of a waterworks system, it is possible to supply drinking water stably to the water consumer by supplying water continuously to the drinking-water producing unit.

In some embodiments, the circulating-water utilization system further includes a drinking-water producing unit configured to produce drinking water for the water consumer by purifying tap water taken in from a waterworks system, and a purified-water supply channel for supplying the drinking-water producing unit with the circulating water purified by the purifying unit, the purified-water supply channel connecting the circulation channel and the drinking-water producing unit. The safety device further includes a second gate valve configured to open and close the purified-water supply channel, a second gate-valve control unit configured to control the second gate valve to open and close, a tap-water monitoring unit configured to monitor a water quality of the tap water, a tap-water shutoff valve capable of shutting off intake of the tap water, and a tap-water shutoff valve control unit configured to control operation of the tap-water shutoff valve. The second gate-valve control unit is configured to open the second-gate valve to supply the drinking-water producing unit with the circulating water purified by the purifying unit, and the shutoff-valve control unit is configured to start operation of the tap-water shutoff valve to shutoff intake of the tap water, if the tap-water monitoring unit detects deterioration of the water quality of the tap water to below a predetermined water quality.

According to this embodiment, if the tap-water monitoring unit detects deterioration of water quality of tap water to below a predetermined water quality, the tap-water shutoff valve control unit starts operation of the tap-water shutoff valve to shutoff intake of tap water, and the second gate-valve control unit opens the second gate valve to supply circulating water purified by the purifying unit to the drinking-water producing unit. Thus, even in the event of deterioration of water quality of tap water, it is possible to supply drinking water stably to the water consumer by supplying water continuously to the drinking-water producing unit.

Advantageous Effects

According to at least one embodiment of the present invention, it is possible to provide a safety device for supplying circulating water stably even if abnormality or the like occurs in a purifying unit of a circulating-water utilization system, with regard to development of a novel circulating-water utilization system.

BRIEF DESCRIPTION OF DRAWINGS

FIG. 2 is a schematic diagram corresponding to the recirculating-water utilization system depicted in FIG. 1, showing an example of a layout of treatment vessels of a purifying unit and a drinking-water producing unit.

FIG. 5 is a schematic diagram corresponding to the recirculating-water utilization system depicted in FIG. 4, showing an example of a layout of treatment vessels of a purifying unit and a drinking-water producing unit.

FIG. 8 is a schematic diagram corresponding to the recirculating-water utilization system depicted in FIG. 7, showing an example of a layout of treatment vessels of a purifying unit and a drinking-water producing unit.

FIG. 11 is a schematic diagram corresponding to the recirculating-water utilization system depicted in FIG. 10, showing an example of a layout of treatment vessels of a purifying unit and a drinking-water producing unit.

DETAILED DESCRIPTION

Embodiments of the present invention will now be described in more detail with reference to the accompanying drawings.

However, the scope of the present invention is not limited to the following embodiments. It is intended that dimensions, materials, shapes, relative positions and the like of components described in the embodiments shall be interpreted as illustrative only and not intended to limit the scope of the present invention.

Figure 1:
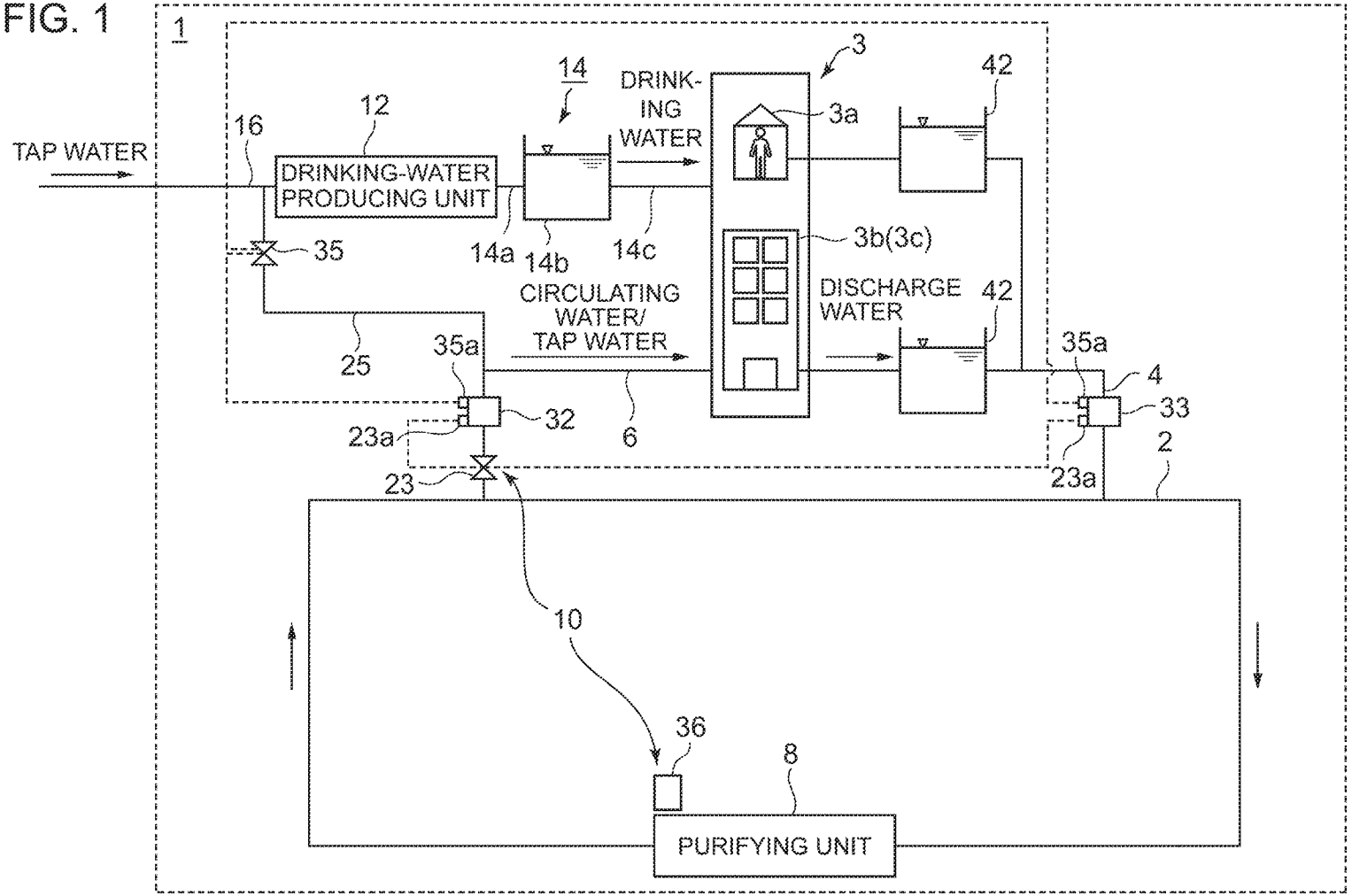
FIG. 1 is an overall schematic diagram of a circulating-water utilization system according to at least one embodiment of the present invention.

FIG. 1 is an overall schematic diagram of a circulating-water utilization system according to at least one embodiment of the present invention.

A circulating-water utilization system 1 is constructed in a specific area separately from a public waterworks system. The present system is designed to be applied to a population of approximately 5,000 to 20,000. An area of application is supposed to be an apartment composed of residences, an office building composed of offices, a commercial facility composed of tenant shops, and a complex composed of combination of the above.

As illustrated in FIG. 1, the circulating-water utilization system 1 includes a circulation channel 2, a water consumer 3, a discharge channel 4, a supply channel 6, a purifying unit 8, a safety device 10, a drinking-water producing unit 12, and a drinking-water supply unit 14, for instance.

The circulation channel 2 is configured as a piping network of water pipeline arranged in a closed loop. Various devices such as a pump (not depicted) and a valve (not depicted) are disposed where needed in the recirculation channel 2 in accordance with terrain conditions or the like, so that circulating water flows circulating in a direction.

Raw water of circulating water that flows through the circulation channel 2 is not limited to tap water supplied from a public waterworks system, and may be well water, river water, rain water, or desalinated sea water, for instance. Further, if circulating water is insufficient, such raw water may be taken into the circulation channel 2 from outside as makeup water. If raw water is taken into the circulation channel 2 as makeup water, the raw water may be taken into treatment vessels of the purifying unit 8 in accordance with the water quality level of the raw water, as described below. For instance, well water, river water, and desalinated sea water, which have a relatively high water quality, may be taken into a coarse-membrane container L4 or a fine-membrane container L5 of the purifying unit 8 described below, and rain water with a relatively low water quality may be taken into a permeable container L2 or an aerobic container L3.

The water consumer 3 is a subjective member that utilizes circulation water flowing through the circulation channel 2 as daily life water. The water consumer 3 is composed of a plurality of water consuming members including at least one of a residence 3*a*, a tenant shop 3*b*, or an office 3*c*. A residence 3*a* refers to a unit of an apartment complex or a stand-alone house inhabited by a family. A tenant shop 3*b* refers to a shop or the like which offers services to the general consumer in a section of a commercial facility. The business category of the tenant shops may include, for instance, the retailing business such as clothing stores, grocery stores, drug stores, and alcohol stores, as well as the food-service business such as restaurants, cafes, sushi bars, and pubs. An office 3*c* refers to a place where employees working at the place do desk work for a certain purpose in a section of an office building, for instance.

In the residence 3*a*, daily life water is used for shower, bath, washing clothes, washing dishes, washing face and hands, toilet, etc. In the tenant shop 3*b*, daily life water is used for cleaning, toilet, etc. The amount of water consumption is widely varied between different kinds of businesses.

For instance, a restaurant uses far more daily life water than a retail store. The office 3*c* mainly uses daily life water for toilet.

Further, the water consumer 3 is supplied with drinking water separately from the above described circulating water. This drinking water is produced by further purifying tap water introduced from a public waterworks system, and has a quality equivalent to that of mineral waters sold at market. This system makes it possible to alleviate anxiety of users who may hesitate to drink circulating water, and is expected to provide a selling point for popularizing the present circulating-water utilization system 1.

Tap water is introduced into the drinking-water producing unit 12 from a public water works system via a tap-water introducing channel 16. The drinking-water producing unit 12 produces drinking water for the water consumer 3 by purifying the introduced tap water. The drinking-water producing unit 12 comprises a container-type treatment vessel including a container that houses a treatment device that performs a treatment step consisting a series of purifying steps, similarly to the purifying unit 8 described below. The drinking-water producing unit 12 may comprise a plurality of the container-type treatment vessels connected in series along an order of treatment steps.

In the present specification, a container refers to a box-shaped reservoir whose dimensions are standardized for transportation purpose.

It should be noted that raw water of drinking water in the circulating-water utilization system 1 is not limited to tap water, and may be well water, river water, or desalinated sea water, for instance.

Drinking water produced by the drinking-water producing unit 12 is supplied to each water consuming member by the drinking-water supply unit 14. The drinking-water supply unit 14 comprises a drinking-water feeding channel 14*a*, a reservoir tank 14*b*, and a drinking-water channel 14*c*. Drinking water produced by the drinking-water producing unit 12 is fed to the reservoir tank 14*b* via the drinking-water feeding channel 14*a* and stored temporarily in the reservoir tank 14*b*. The drinking water stored in the reservoir tank 14*b* is supplied to each of the water consuming members including the above described residence 3*a*, tenant shop 3*b*, and office 3*c* via the drinking-water channel 14*c*.

The discharge channel 4 is a channel for draining wastewater discharged from the water consumer 3 to the circulation channel 2. Wastewater discharged from the discharge channel 4 includes drinking water and water not from the system, in addition to circulating water having been utilized by the water consumer 3 as daily life water. The supply channel 6 is a channel for supplying circulating water purified by the following purifying unit 8 to the water consumer 3 as daily life water. The discharge channel 4 and the supply channel 6 both comprise pipeline. Various devices such as a pump (not depicted) and a valve (not depicted) are disposed where needed in the discharge channel 4 and the supply channel 6 in accordance with terrain conditions or the like, so that wastewater drains to the circulation channel 2, or circulating water is supplied to the water consumer 3.

The purifying unit 8 is a unit to purify circulating water including wastewater flowing through the circulation channel 2. The purifying unit 8 comprises a container-type treatment vessel which is a container that houses a treatment device which performs a treatment step constituting a series of purifying steps. The drinking-water producing unit 12 may comprise a plurality of container-type treatment vessels connected in series along an order of a treatment step.

Further, in the present circulating-water utilization system 1, the circulation channel 2 is not connected to a public sewage system. As described below, excess sludge such as sludge cake produced during purification of wastewater is carried out of the system, but otherwise wastewater is re-utilized 100%. In other words, the present circulating-water utilization system 1 is a fully-circulation type circulating-water utilization system that supplies and processes water in circulation within the system, and does not discharge sewage water out of the system.

FIG. 2 is a schematic diagram corresponding to the recirculating-water utilization system depicted in FIG. 1, showing an example of a layout of treatment vessels of a purifying unit and a drinking-water producing unit. In an embodiment illustrated in FIG. 2, the purifying unit 8 comprises a screening/flow-rate-adjusting container L1, an anaerobic container L2, an aerobic container L3, a coarse-membrane container L4, a fine-membrane container L5, an ozonizing container L6, a stored-water-sterilizing container L7, and a disinfecting container L8, connected in series in this order.

The screening/flow-rate-adjusting container L1 is a treatment vessel that removes residue or oil from wastewater, and equipped with an oil trap, a screening device, or the like. The anaerobic container L2 and the aerobic container L3 are treatment vessels for removing organic substances from wastewater by performing an anaerobic treatment and an aerobic treatment. Various known processes may be employed for the treatments, including the A20 activated sludge process, the batch activated sludge process, the contact oxidation process, and the oxidation ditch process, for instance. The coarse-membrane container L4 is a treatment vessel for separating sludge from wastewater. Various devices and processes may be employed, including a settling tank, a MF membrane, a UF membrane, and centrifugal separation, for instance. The fine-membrane container L5 is a treatment vessel for improving the water quality of circulating water to the level of clean water. Various devices and processes may be employed, including a reverse osmosis membrane, activated charcoal, a sand filter, an ozone generator, an ion exchanger, and a mineral adding device, for instance. The ozonizing container L6 is a treatment vessel for ozonizing purified circulating water. The stored-water-sterilizing container L7 is a treatment vessel for storing purified circulating water temporarily while sterilizing the circulating water with UV or the like. The disinfecting container L8 is a treatment vessel for disinfecting purified circulating water with UV, chlorine, ozone, or the like.

A sludge-returning/sludge-dewatering container L9 is a treatment vessel for dewatering and drying sludge. Sludge-storing containers L10, L11 are treatment vessels for storing waste produced during sewage treatment. The waste includes, for instance, sludge cake and residue. Excess sludge such as sludge cake stored in the sludge-storing containers L10, L11 are carried out of the system by, for instance, being collected by a fertilizer maker.

Further, in an embodiment illustrated in FIG. 2, the drinking-water producing unit 12 comprises a fine-membrane container H1, an ion-exchanging container H2, a stored-water-sterilizing container H3, a mineral-adjusting container H4, and a disinfecting container H5, connected in series in this order. The fine-membrane container H1, the ion-exchanging container H2, the stored-water-sterilizing container H3, the mineral-adjusting container H4, and the disinfecting container H5 are treatment vessels for further purifying tap water to improve its quality as high as that of mineral waters sold in market.

The fine-membrane container H1 includes various devices and processes such as a reverse osmosis membrane, activated charcoal, and a sand filter, for instance. The ion-exchanging container H2 includes an ion-exchanging device, for instance. The stored-water-sterilizing container H3 is a treatment vessel for storing purified tap water temporarily while sterilizing the tap water with UV or the like. The mineral-adjusting container H4 includes a mineral-adding device, for instance. The disinfecting container H5 is a treatment vessel for disinfecting purified tap water with UV, chlorine, ozone, or the like.

It should be noted that the above described layouts and configurations of the treatment vessels of the purifying unit 8 and the drinking-water producing unit 12 are merely examples, and various modifications may be implemented in accordance with a water quality of wastewater to be discharged or a target purification standard. Further, the reference sign TW in the drawing represents a flow of tap water supplied from a public water works system. Tap water TW may be supplied not only to the drinking-water producing unit 12 as described above, but also to the circulation channel 2 as makeup water if needed. In this case, tap water TW may be supplied at a downstream side of the fine-membrane container L5, where purification of wastewater is nearly completed. Further, the reference sign WW4 in the drawing represents a returning line for feeding concentrated water to the screening/flow-rate-adjusting container L1.

As described above, in the novel circulating-water utilization system 1 being developed by the present applicant, the purifying unit 8 for purifying wastewater and the drinking-water producing unit 12 for purifying tap water both comprise container-type treatment vessels which include containers each of which houses a treatment device that performs a treatment step, which is one of three or more treatment steps into which a series of purifying steps is divided. A container-type treatment vessel that performs the first treatment step, a container-type treatment vessel that performs the second treatment step, and a container type treatment vessel that performs the third treatment step are carried into a site, and connected in series via connection piping, and thereby the purifying unit 8 is constructed. Such a container-type treatment vessel can be loaded onto a truck to be transported as it is, and thus has a high transportability. Further, such a container-type treatment vessel is housed in a container housing removably, and thus can be installed and removed as desired.

With regard to processing capacity, the above container-type treatment vessels are each supposed to be capable of processing wastewater from approximately 1,000 persons. Thus, to introduce the present circulating-water utilization system to an area or a complex inhabited by as many as 10,000 persons, for instance, a plurality of (e.g. ten) treatment vessels that performs the same treatment process is required. With a plurality of treatment vessels that performs the same treatment process provided as described above, it is possible to reduce processing capacity per treatment vessel. Thus, it is possible to flexibly address population variation in a target area or seasonal variation of water demand. Further, a substitute treatment vessel can be prepared readily, and maintainability is improved.

The safety device 10 is a device for supplying circulating water stably to a water consumer even if there is abnormality or the like in the above described purifying unit 8.

As depicted in FIG. 1, the safety device 10 includes at least one of a circulating-water monitoring unit 32 which monitors water quality of circulating water purified by the purifying unit 8 or a treatment-vessel monitoring unit 36 which detects abnormality of treatment vessels constituting the purifying unit 8.

The circulating-water monitoring unit 32 is disposed downstream of the purifying unit 8, and in the depicted embodiment, disposed in the supply channel 6. For an example, the circulating-water monitoring unit 32 may comprise a an automatic water-quality monitoring device which automatically measures color intensity, turbidity, remaining chlorine, pH, conductivity, temperature, or the like of circulating water, for example at a predetermined interval of time. Further, the circulating-water monitoring unit 32 may comprise a portable water-quality test kit, a micro-fluidic device, or the like, instead of a fixed water-quality monitoring device.

The treatment-vessel monitoring unit 36 is configured as a microcomputer including a central processing unit (CPU), a random access memory (RAM), a read only memory (ROM), and an I/O interface. Further, each of the treatment vessels constituting the purifying unit 8 is provided with an abnormality detecting sensor for detecting abnormality of the treatment vessel. If the abnormality detecting sensor detects abnormality of the treatment vessel of the purifying unit 8, the abnormality information is transmitted to the treatment-vessel monitoring unit 36 via wire or wirelessly.

As described above, the safety device 10 of the circulating-water utilization system 1 according to an embodiment of the present invention includes at least one of a circulating-water monitoring unit 32 which monitors water quality of circulating water purified by the purifying unit 8 or a treatment-vessel monitoring unit 36 which detects abnormality of treatment vessels constituting the purifying unit 8. Thus, it is possible to detect abnormality of the purifying unit 8 instantly, and to perform repair and maintenance quickly on the treatment vessel in which abnormality is detected.

In the above embodiment, the treatment vessels constituting the drinking-water producing unit 12 may also be provided with an abnormality detecting sensor for detecting abnormality of the treatment vessel. If the abnormality detecting sensor detects abnormality of the treatment vessel, the abnormality information may be transmitted to the treatment-vessel monitoring unit 36 via wire or wirelessly.

According to this embodiment, it is possible to detect abnormality of the purifying unit 8 of the drinking-water producing unit 12 instantly, and to perform repair and maintenance quickly on the treatment vessel in which abnormality is detected.

Further, in the above embodiment, each of the treatment vessels constituting the purifying unit 8 and the drinking-water producing unit 12 may be provided with an operational-ratio sensor for detecting an operational ratio of the treatment vessel. Information related to the operational ratios of the respective treatment vessels detected by the operational-ratio sensors may be transmitted to the treatment-vessel monitoring unit 36 disposed at a distance from the purifying unit 8 via wire or wirelessly. The transmitted data related to the operational ratios of the respective treatment vessels is displayed on a display unit of the treatment-vessel monitoring unit 36. An operator who manages the present circulating-water utilization system 1 monitors the operational ratios of the respective treatment vessels displayed by the treatment-vessel monitoring unit 36.

According to this embodiment, the operational ratios of the treatment vessels constituting the purifying unit 8 and the drinking-water producing unit 12 are monitored remotely, which makes it possible to determine addition and removal of treatment vessels quickly and readily.

In some embodiments, as depicted in FIG. 1, the above described safety device 10 further includes a circulating water shutoff valve 23 disposed in the supply channel 6 and capable of shutting off supply of circulating water purified by the purifying unit 8 to the water consumer 3, and a circulating water shutoff valve control unit 23*a* capable of controlling operation of the circulating water shutoff valve 23. If the circulating-water monitoring unit 32 detects deterioration of the water quality of circulating water purified by the purifying unit 8 to below a predetermined water quality, the circulating water shutoff valve control unit 23*a* starts operation of the circulating water shutoff valve 23 to shut off supply of circulating water to the water consumer 3.

According to this embodiment, supply of circulating water to the water consumer 3 is shut off if the circulating-water monitoring unit 32 detects deterioration of the water quality of circulating water to below a predetermined water quality, and thereby it is possible to prevent circulating water with a deteriorated water quality from being supplied to the water consumer 3.

In the above embodiment, as depicted in FIG. 1, the above described circulating-water utilization system 1 further includes an abnormality-time supply channel 25 connecting a waterworks system and the supply channel 6 at a downstream side of the circulating water shutoff valve 23. Further, the above described safety device 10 further includes a gate valve 35 disposed in the abnormality-time supply channel 25 and configured to open and close the abnormality-time supply channel 25, and a gate-valve control unit 35*a* capable of controlling the gate valve 35 to open and close. If the circulating-water monitoring unit 32 detects deterioration of the water quality of circulating water purified by the purifying unit 8 to below a predetermined water quality, the circulating water shutoff valve control unit 23*a* starts operation of the circulating water shutoff valve 23 to shut off supply of circulating water to the water consumer 3, and the gate-valve control unit 35*a* opens the gate valve 35 to supply tap water from a waterworks system to the supply channel 6.

According to this embodiment, supply of circulating water to the water consumer 3 is shut off and tap water is supplied to the water consumer 3 as daily life water instead of circulating water, if the circulating-water monitoring unit 32 detects deterioration of the water quality of circulating water to below a predetermined water quality. Thus, it is possible to supply daily life water stably to the water consumer 3 even if the water quality of circulating water deteriorates.

In the above embodiment, the safety device 10 further includes a wastewater monitoring unit 33 which monitors water quality of wastewater flowing through the discharge channel 4, and a plurality of wastewater storage tanks 42 each of which is capable of storing a predetermined amount of wastewater discharged from corresponding one of the plurality of water consuming members constituting the water consumer 3. If the wastewater monitoring unit 33 detects contamination of wastewater flowing through the discharge channel 4 with a predetermined harmful substance, the circulating water shutoff valve control unit 23*a* starts operation of the circulating water shutoff valve 23 to shut off supply of circulating water to the water consumer, and the gate-valve control unit 35*a* opens the gate valve 35 to supply tap water from a waterworks system to the supply channel 6.

For example, the wastewater monitoring unit 33 may comprise an automatic water-quality monitoring device which automatically measures presence and a contained amount of a harmful substance specified in advance as a harmful substance that should not be contained in circulating water, such as arsenic, heavy metal, mercury, chrome, cadmium, tin, and lead, at a predetermined interval. Further, the wastewater monitoring unit 33 may comprise a portable water-quality test kit, a micro-fluidic device, or the like, instead of a fixed water-quality monitoring device.

According to this embodiment, supply of circulating water to the water consumer 3 is shut off and tap water is supplied to the water consumer 3 as daily life water instead of circulating water, if the wastewater monitoring unit 33 detects contamination of wastewater flowing through the discharge channel 4 with a predetermined amount or more of a predetermined harmful substance. Thus, it is possible to avoid circulating water containing a harmful substance from being supplied to the water consumer 3.

Further, as depicted in FIG. 1, the safety device 10 of the present embodiment includes a plurality of wastewater storage tanks 42 each of which is capable of storing a predetermined amount of wastewater discharged from corresponding one of the plurality of water consuming members. Thus, water quality of wastewater stored in the plurality of wastewater storage tanks 42 is checked if the wastewater monitoring unit 33 detects contamination of wastewater flowing through the discharge channel 4 with a predetermined amount or more of a harmful substance, and thereby it is possible to specify an emission source of the harmful substance at an early stage.

Figure 3:
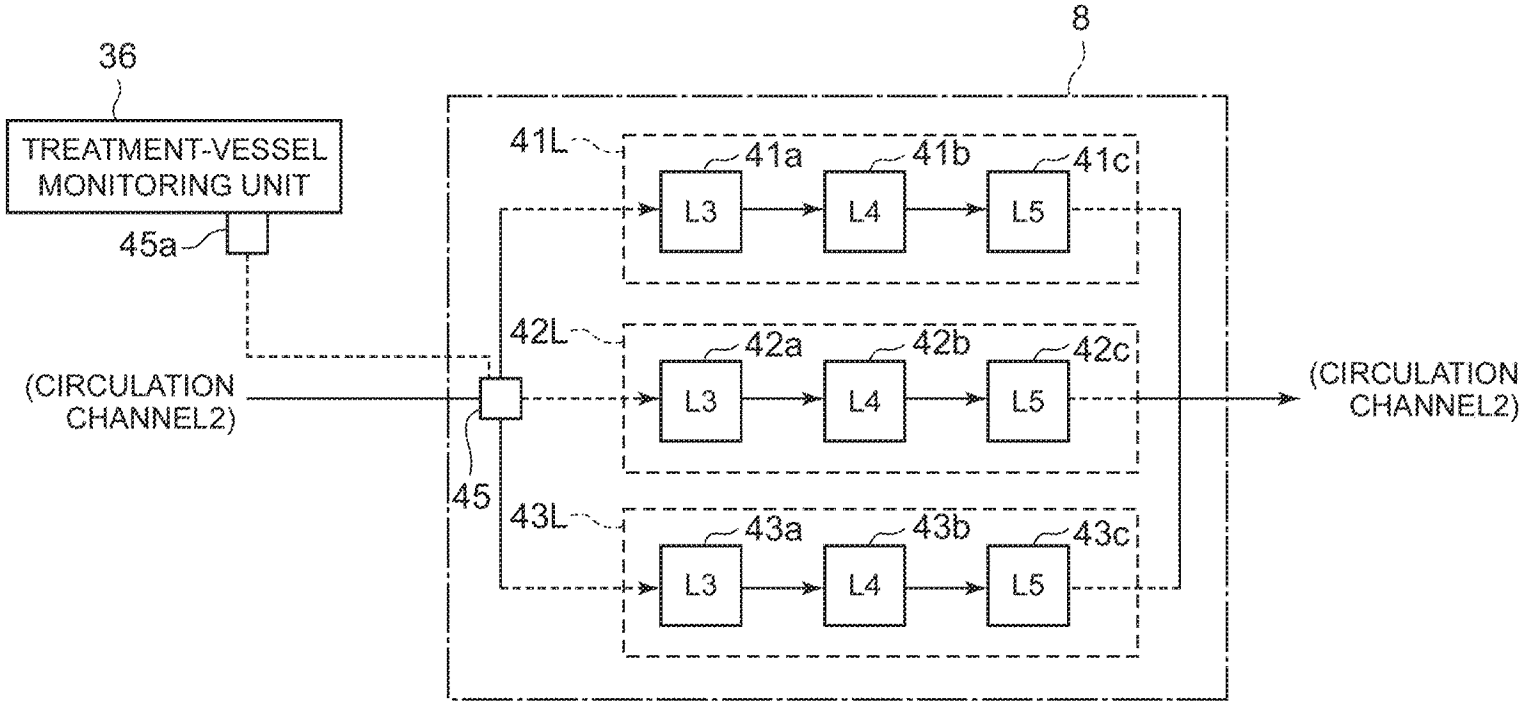
FIG. 3 is a block diagram for describing the function of a treatment-vessel monitoring unit.

FIG. 3 is a block diagram for describing the function of a treatment-vessel monitoring unit.

In some embodiments, the above described purifying unit 8 comprises three rows of treatment vessels including the first treatment vessel low 41L, the second treatment-vessel row 42L, and the third treatment-vessel row 43L. The first treatment-vessel row L1 includes the first treatment vessels 41*a*, 41*b*, 41*c* (e.g. the aerobic container L3) connected in series, each comprising a container that houses a treatment device which performs a treatment step which is one of three or more treatment steps into which a series of purifying steps for purifying wastewater is divided. The second treatment-vessel row L2 includes the second treatment vessels 42*a*, 42*b*, 42*c* (e.g. the coarse-membrane container L4) connected in series, each comprising a container that houses a treatment device which performs the next treatment step of the treatment step performed by the first treatment vessels 41*a*, 41*b*, 41*c* of the plurality of treatment steps. The third treatment-vessel row includes the third treatment vessels 43*a*, 43*b*, 43*c* (e.g. the fine-membrane container L5) connected in series, each comprising a container that houses a treatment device which performs the next treatment step of the treatment step performed by the second treatment vessels 42*a*, 42*b*, 42*c*. Further, the above described safety device 10 includes a switching unit 45 capable of switching a flow of circulating water containing wastewater so as to make the circulating water flow to a certain one of the three treatment-vessel rows 41L, 42L, 43L, and a switching-unit control unit 45*a* capable of controlling the switching unit 45. If the treatment-vessel monitoring unit 36 detects abnormality of a treatment vessel, the switching-unit control unit 45*a* controls the switching unit 45 so that circulating water does not flow to the treatment-vessel row including the treatment vessel in which abnormality is detected.

For instance, if abnormality is detected in the second treatment vessel 42*b*, the switching-unit control unit 45*a* controls the switching unit 45 so that circulating water does not flow to the second treatment-vessel row 42L including the second treatment vessel 42*b*. In this case, the circulating water containing the wastewater flows through one or both of the first treatment-vessel row 41L and the third treatment-vessel row 43L.

While there are three treatment-vessel rows in the depicted embodiment, the number of the treatment-vessel rows is not limited and it is sufficient if there are more than one row. Further, while three treatment vessels are connected in series in one treatment-vessel row in the description for the sake of convenience, it is sufficient if there is a plurality of treatment vessels connected in series.

According to this embodiment, if the treatment-vessel monitoring unit 36 detects abnormality of a treatment vessel, the switching unit 45 is controlled so that circulating water does not flow to the treatment-vessel row including the treatment vessel in which abnormality is detected, and thus it is possible to prevent deterioration of water quality of circulating water in advance. Further, since the switching unit 45 switches a flow of circulating water, it is possible to perform repair and maintenance quickly on the treatment vessel in which abnormality is detected.

Figure 4:
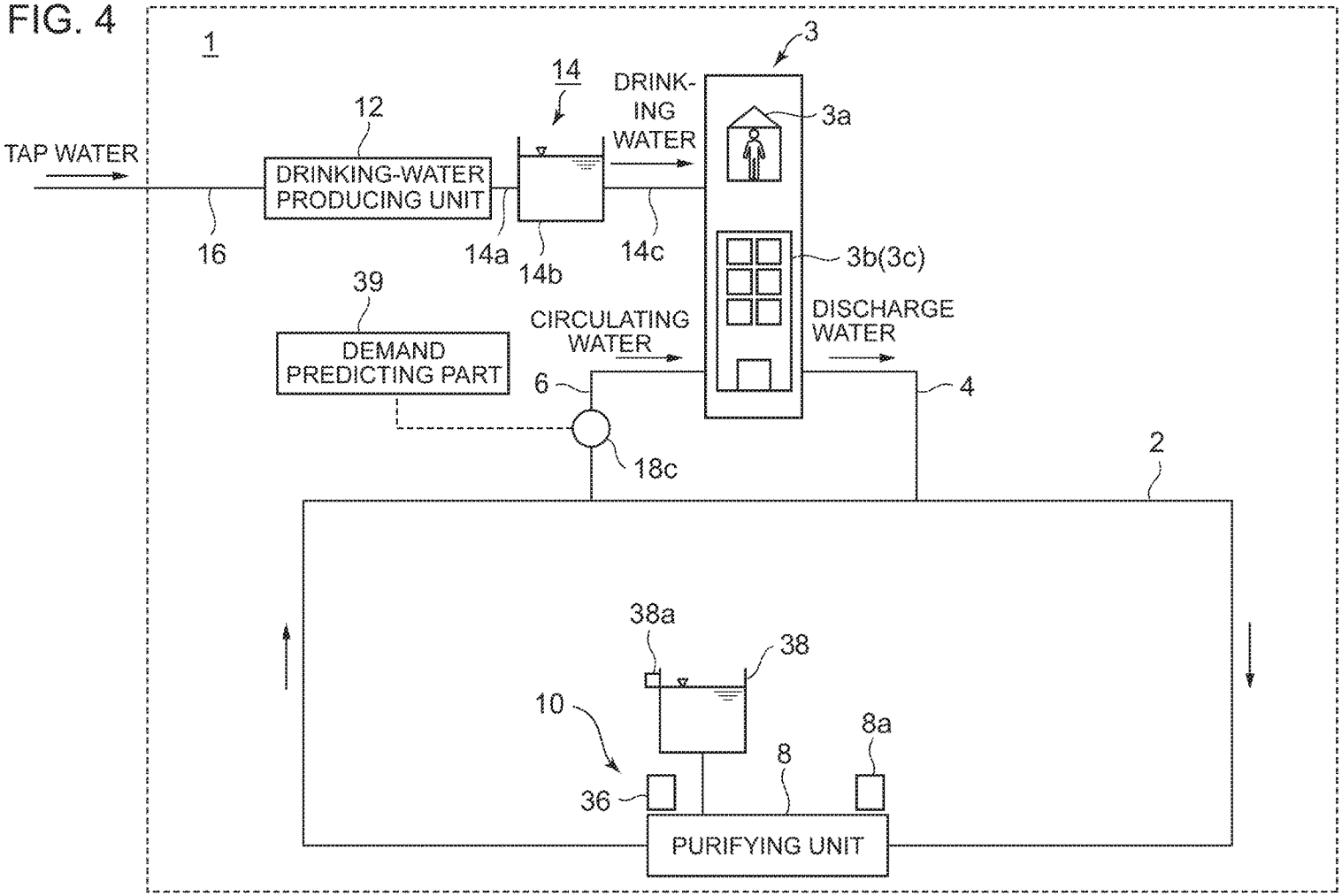
FIG. 4 is an overall schematic diagram of a circulating-water utilization system according to at least one embodiment of the present invention.

FIG. 4 is an overall schematic diagram of a circulating-water utilization system according to at least one embodiment of the present invention. FIG. 5 is a schematic diagram corresponding to the recirculating-water utilization system depicted in FIG. 4, showing an example of a layout of treatment vessels of a purifying unit and a drinking-water producing unit.

In some embodiments, as depicted in FIG. 4, the circulating-water utilization system 1 further includes a circulating-water storage tank 38 for storing circulating water purified by the purifying unit 8.

Figure 6:
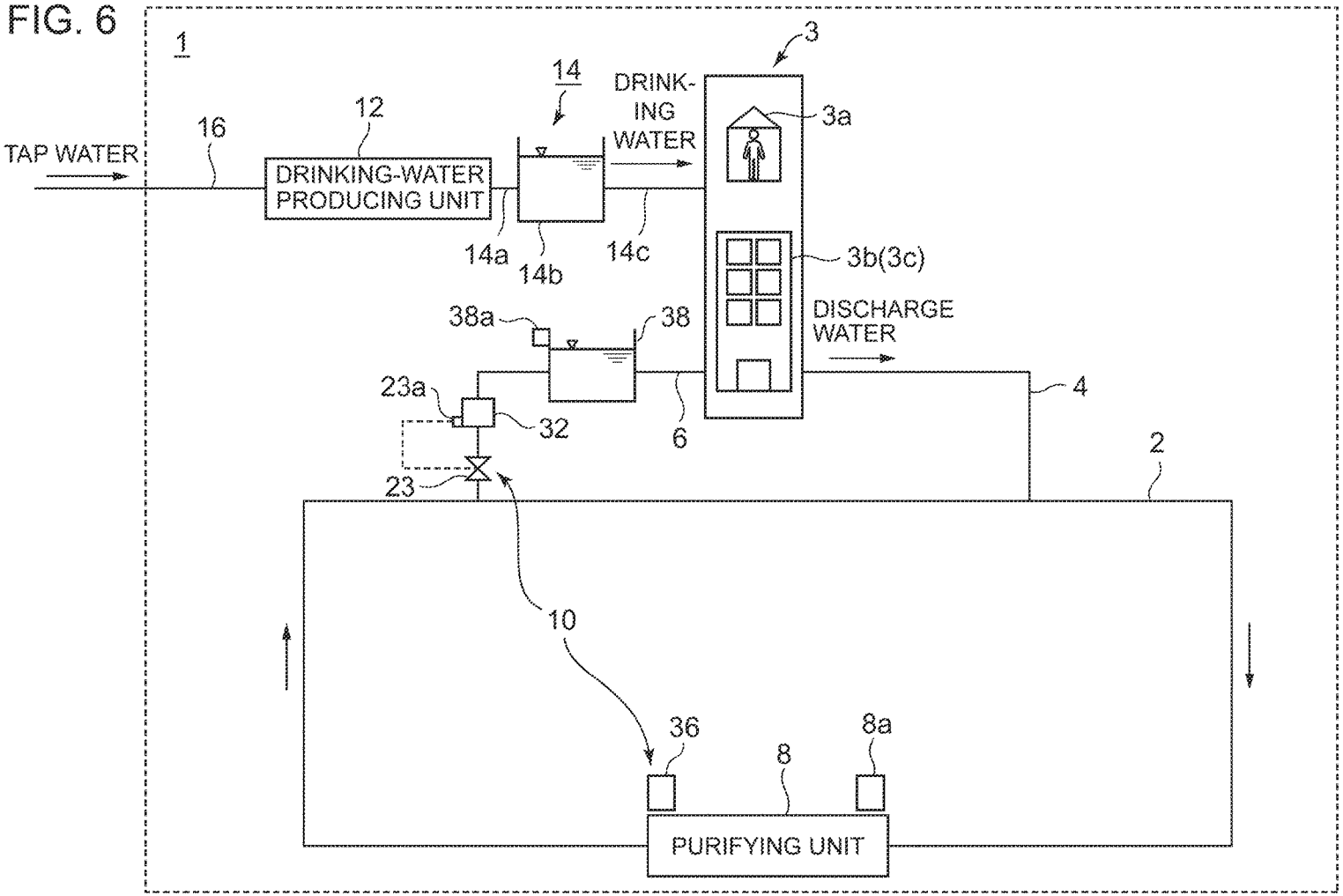
FIG. 6 is a modified example of the circulating-water utilization system depicted in FIG. 4.

The capacity of the circulating-water storage tank 38 is set to, for instance, approximately an amount of daily life water consumed by the water consumer 3 per day. The circulating-water storage tank 38 may be provided separately from the purifying unit 8, or the above described stored-water-sterilizing container L7 may serve as the circulating-water storage tank 38, as depicted in FIG. 5. Further, it is sufficient if the circulating-water storage tank 38 is disposed downstream of the purifying unit 8, and may be disposed in the supply channel 6 as depicted in FIG. 6. In this case, with the circulating-water storage tank 38 disposed downstream of the circulating-water shutoff valve 23, it is possible to supply circulating water stored in the circulating-water storage tank 38 to the water consumer 3 even if the circulating water shutoff valve 23 is in operation.

According to this embodiment, it is possible to address shortage of circulating water to be supplied to the water consumer 3 by supplying circulating water stored in the circulating-water storage tank 38 to the water consumer 3, even if the water quality of the circulating water deteriorates or even if the purifying ability of the purifying unit 8 decreases temporarily due to abnormality of a treatment vessel.

In the above embodiment, the safety device 10 further includes a storage-amount measuring unit 38*a* which measures a storage amount of circulating water stored in the circulating-water storage tank 38, and a purifying-unit control unit 8*a* which controls operation of the purifying unit 8.

The storage-amount measuring unit 38*a* may be, for an example, a water gauge which measures a water level of the circulating-water storage tank 38. The purifying-unit control unit 8*a* is configured to control operation of the entire purifying unit 8 by controlling pumps and valves, for instance, to control supply of circulating water to be fed to the purifying unit 8 or by controlling operation of devices of various treatment vessels constituting the purifying unit 8.

According to this embodiment, purification cost can be reduced by, for instance, operating the purifying unit 8 in preference during hours when electric fee is less expensive, such as night time. Further, if the storage amount of the circulating-water storage tank 38 measured by the storage-amount measuring unit 38*a* is below a predetermined storage amount, the purifying unit 8 is operated regardless of time, which makes it possible to avoid shortage of daily life water to be supplied to the water consumer 3.

In some embodiments, as depicted in FIG. 4, the circulating-water utilization system 1 comprises a daily-life-water amount measurement unit 18*c* which measures an amount of daily life water to be supplied to the water consumer 3 from the supply channel 6, and a demand predicting part 39 which predicts demand for an amount of daily life water.

The demand predicting part 39 is configured as a microcomputer including a central processing unit (CPU), a random access memory (RAM), a read only memory (ROM), and an I/O interface. The daily-life-water amount measurement unit 18*c* comprises, for instance, a flow meter 18*c*. Further, the demand predicting part 39 is configured to store measurements of daily-life-water amounts obtained by the daily-life-water amount measurement unit 18*c* hourly, and to predict future water demand for daily life water on the basis of the past daily-life-water amounts stored therein.

Water demand may be predicted by using a daily-life-water amount supplied on the same month, date, day of week, time slot, or the like in the past as a predicted value of water demand. Further, the predicted value of water demand may be corrected on the basis of ambient information such as temperature and humidity.

According to this embodiment, it is possible to operate the purifying unit 8 in accordance with a prediction result of water demand, which makes it possible to operate the purifying unit 8 efficiently.

Figure 7:
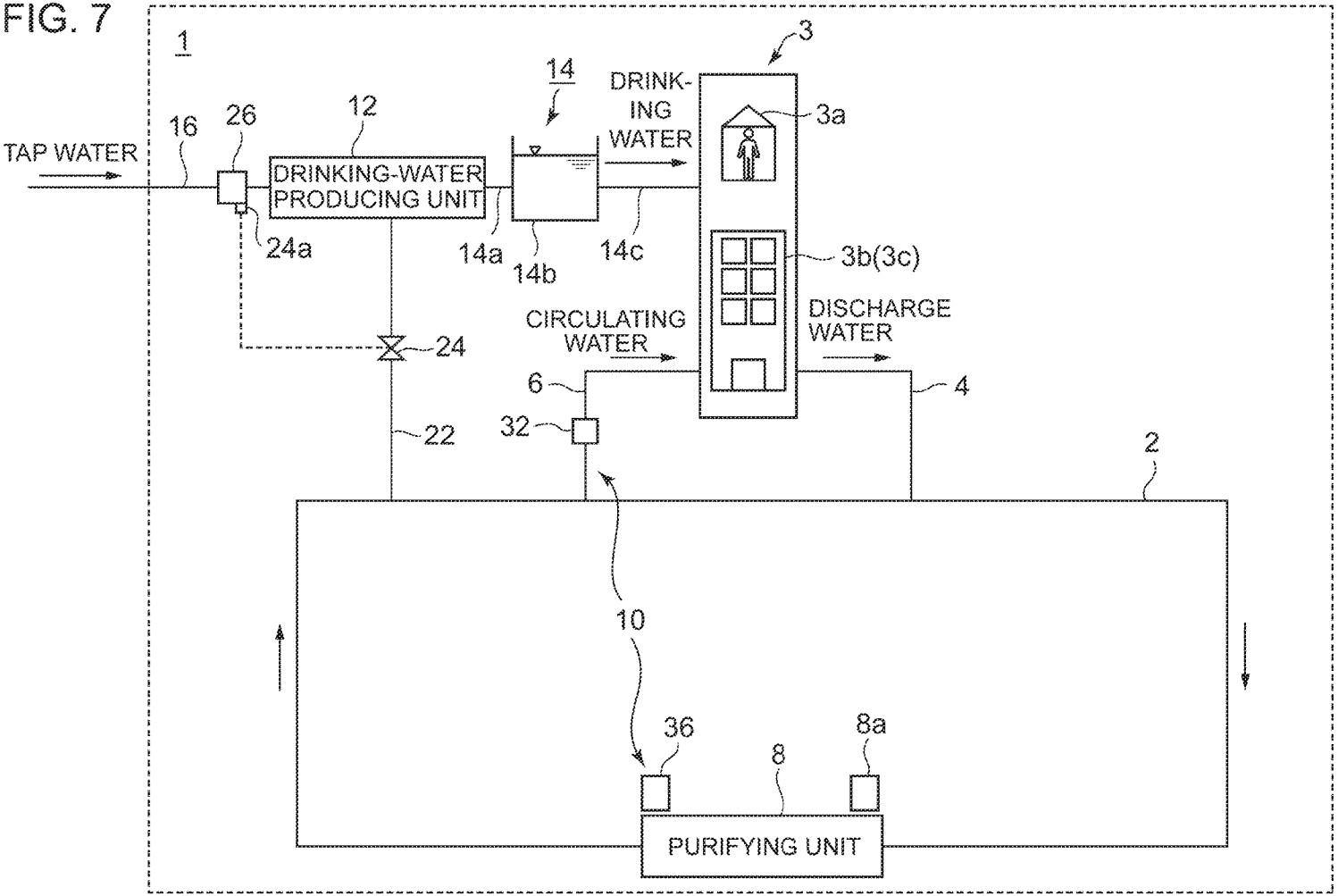
FIG. 7 is an overall schematic diagram of a circulating-water utilization system according to at least one embodiment of the present invention.

FIG. 7 is an overall schematic diagram of a circulating-water utilization system according to at least one embodiment of the present invention. FIG. 8 is a schematic diagram corresponding to the recirculating-water utilization system depicted in FIG. 7, showing an example of a layout of treatment vessels of a purifying unit and a drinking-water producing unit.

In some embodiments, as depicted in FIG. 7, the above described circulating-water utilization system 1 further comprises a purified-water supply channel 22 connecting the circulation channel 2 and the drinking-water producing unit 12, for supplying circulating water purified by the purifying unit 8 to the drinking-water producing unit 12. The above described safety device 10 further includes the second gate valve 24 which opens and closes the purified-water supply channel 22, an outage detecting unit 26 capable of detecting outage of a waterworks system, and the second gate-valve control unit 24*a* which controls the second gate valve 24 to open and close. If the outage detecting unit 26 detects outage of a waterworks system, the second gate-valve control unit 24*a* opens the second gate valve 24 to supply circulating water purified by the purifying unit 8 to the drinking-water producing unit 12. Outage may be detected by utilizing outage information issued by a waterworks bureau.

According to this embodiment, if the outage detecting unit 26 detects outage of a waterworks system, the second gate-valve control unit 24*a* opens the second gate valve 24 to supply circulating water purified by the purifying unit 8 to the drinking-water producing unit 12. Thus, even in the event of water outage of a waterworks system, it is possible to supply drinking water stably to the water consumer 3 by supplying water continuously to the drinking-water producing unit 12.

Figure 9:
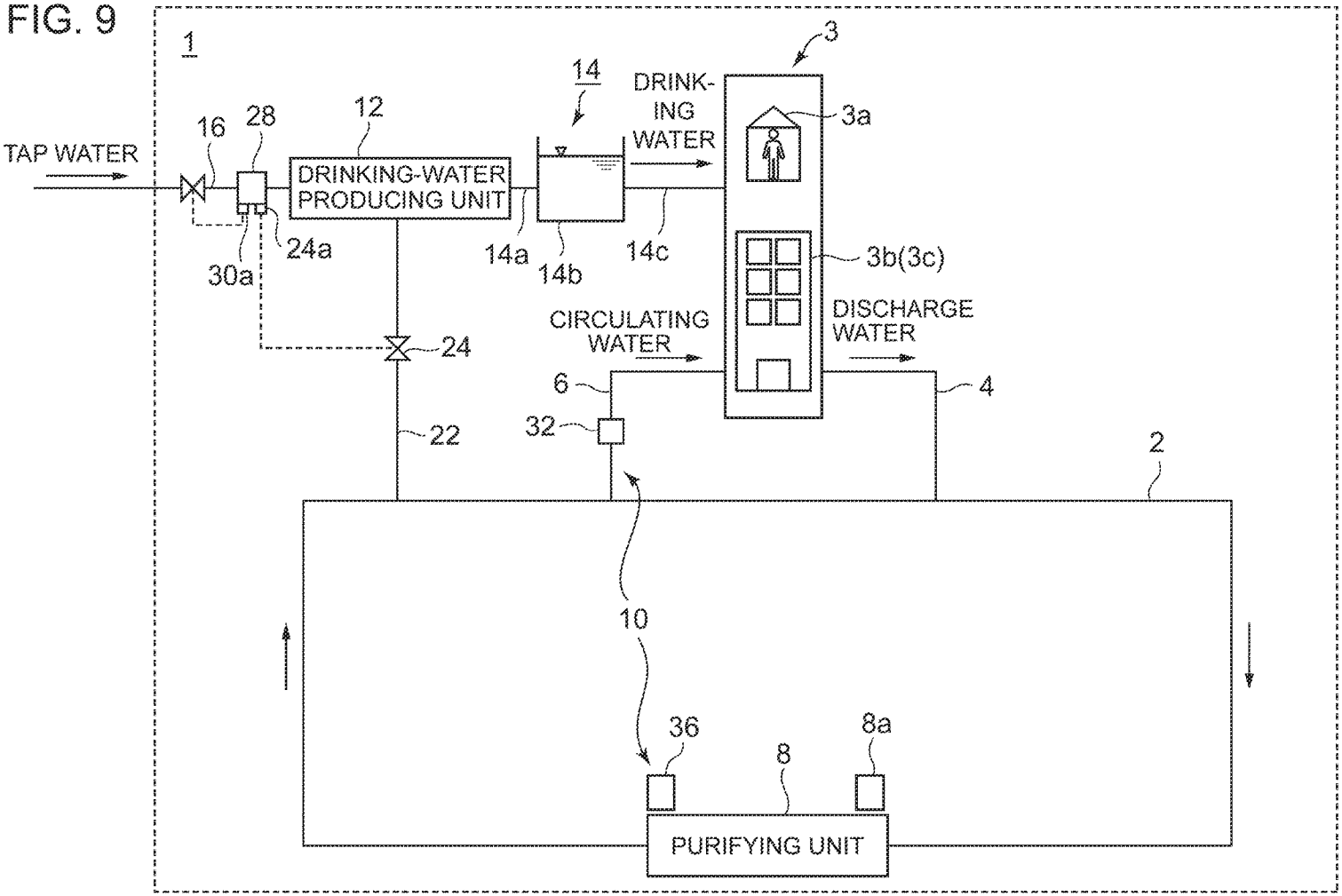
FIG. 9 is an overall schematic diagram of a circulating-water utilization system according to at least one embodiment of the present invention.

FIG. 9 is an overall schematic diagram of a circulating-water utilization system according to at least one embodiment of the present invention.

In some embodiments, similarly to the above described embodiment, the above described circulating-water utilization system 1 further comprises a purified-water supply channel 22 connecting the circulation channel 2 and the drinking-water producing unit 12, for supplying circulating water purified by the purifying unit 8 to the drinking-water producing unit 12. Further, the above described safety device 10 includes the second gate valve 24 which opens and closes the purified-water supply channel 22, the second gate-valve control unit 24*a* which controls the second gate valve 24 to open and close, a tap-water monitoring unit 28 which monitors the water quality of tap water, a tap-water shutoff valve 30 capable of shutting off intake of tap water, and a tap-water shutoff valve control unit 30*a* which controls operation of the tap-water shutoff valve 30. If the tap-water monitoring unit 28 detects deterioration of the water quality of tap water to below a predetermined water level, the second gate-valve control unit 24*a* opens the second gate valve 24 to supply circulating water purified by the purifying unit 8 to the drinking-water producing unit 12, and the shutoff-valve control unit 30*a* starts operation of the tap-water shutoff valve 30 to shut off intake of tap water.

For an example, the tap-water monitoring unit 28 may comprise a an automatic water-quality monitoring device which automatically measures color intensity, turbidity, remaining chlorine, pH, conductivity, temperature, or the like of tap water, for example at a predetermined interval of time, similarly to the circulating-water monitoring unit 32. Further, the tap-water-quality monitoring unit 28 may comprise a portable water-quality test kit, a micro-fluidic device, or the like, instead of a fixed water-quality monitoring device.

According to this embodiment, if the tap-water monitoring unit 28 detects deterioration of water quality of tap water to below a predetermined water quality, the tap-water shutoff valve control unit 30*a* starts operation of the tap-water shutoff valve 30 to shutoff intake of tap water, and the second gate-valve control unit 24*a* opens the second gate valve 24 to supply circulating water purified by the purifying unit 8 to the drinking-water producing unit 12. Thus, even in the event of deterioration of water quality of tap water, it is possible to supply drinking water stably to the water consumer 3 by supplying water continuously to the drinking-water producing unit 12.

Figure 10:
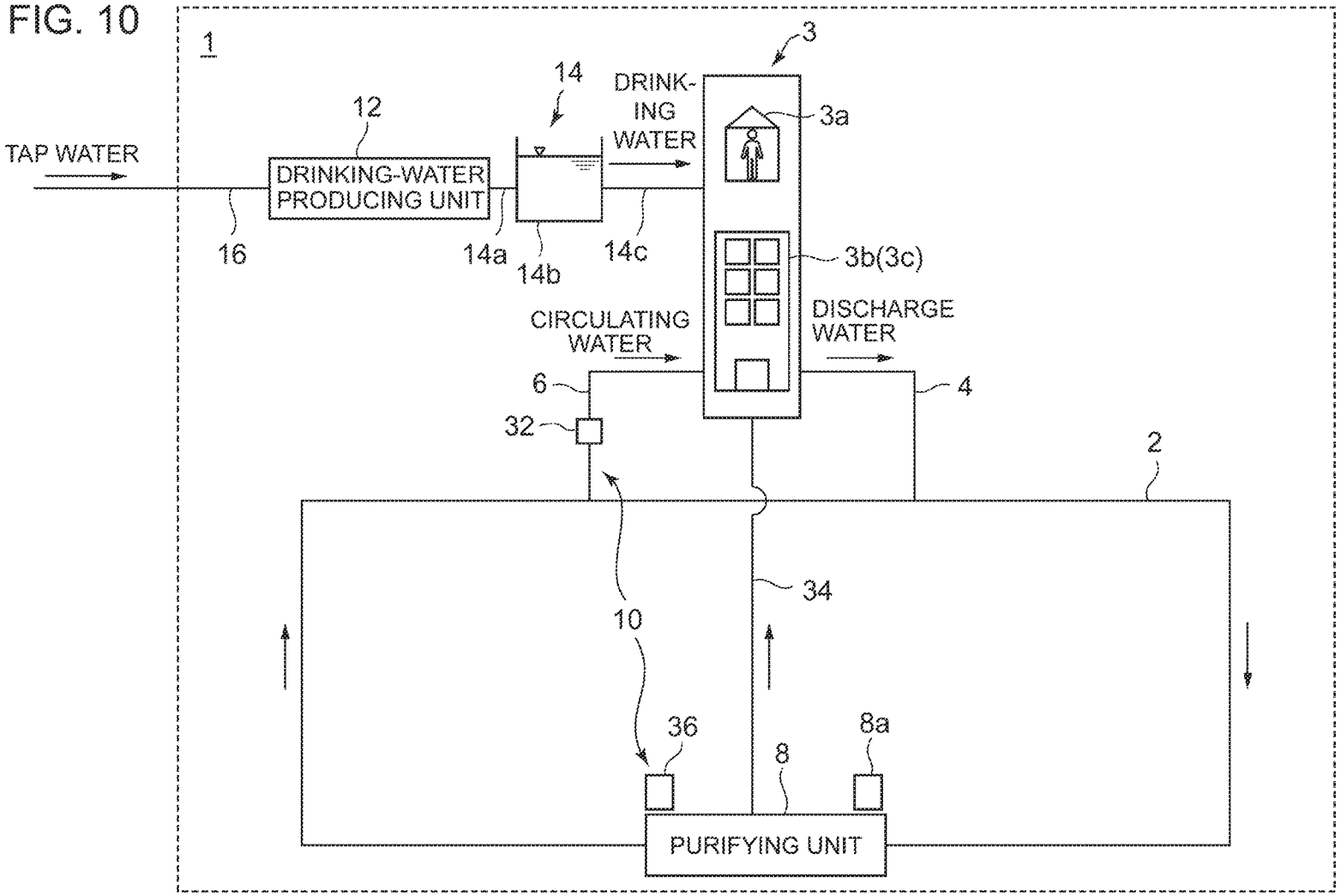
FIG. 10 is an overall schematic diagram of a circulating-water utilization system according to at least one embodiment of the present invention.

FIG. 10 is an overall schematic diagram of a circulating-water utilization system according to at least one embodiment of the present invention. FIG. 11 is a schematic diagram corresponding to the recirculating-water utilization system depicted in FIG. 10, showing an example of a layout of treatment vessels of a purifying unit and a drinking-water producing unit.

In some embodiments, as depicted in FIGS. 10 and 11, two of the treatment vessels L1 to L8 constituting the purifying unit 8 are a sludge-separating treatment vessel with a micro-filtering membrane for filtering sludge contained in wastewater, and an advanced treatment vessel for filtering wastewater which is the next treatment step of the treatment step performed by the sludge-separating treatment vessel. Further, the circulating-water utilization system 1 further comprises a gray-water supply channel 34 which supplies processed water discharged from the sludge-separating treatment vessel to the water consumer 3 as gray water.

The sludge-separating treatment vessel with a micro-filtering membrane for filtering sludge contained in wastewater corresponds to a coarse-membrane container L4 of the plurality of treatment vessels consisting the above described purifying unit 8. Further, the advanced treatment vessel for filtering wastewater corresponds to the fine-membrane container L5 of a plurality of treatment vessels consisting the above described purifying unit 8.

If the water consumer 3 is an office building or the like composed of a plurality of the offices 3*c*, a larger proportion of daily life water supplied to the water consumer 3 may be for a usage that does not involve contact with human skin, such as flushing toilets. Thus, according to this embodiment, circulating water purified by a sludge-separating treatment vessel to such a level that the circulating water can be utilized as flushing water is supplied to the water consumer 3 as gray water, which makes it possible to reduce energy cost of subsequent purifying steps.

Further, with the gray-water supply channel 34 which supplies purified circulating water to the water consumer 3 as gray water, it is possible to utilize circulating water purified by the purifying unit 8 as gray water, even if water quality of circulating water purified by the purifying unit 8 deteriorates to below a predetermined water level, or if contamination of wastewater with a predetermined amount or more of a harmful substance is detected and the circulating water shutoff valve 23 operates to stop supply of circulating water to the water consumer 3, as in the above embodiment.

The embodiments of the present invention have been described above. However, the present invention is not limited thereto. For instance, various modifications may be applied as long as they do not depart from the object of the present invention.

INDUSTRIAL APPLICABILITY

At least an embodiment of the present invention can be suitably applied as a circulating water utilization system to be constructed in a specific area separately from a public waterworks system.

DESCRIPTION OF REFERENCE NUMERALS

1 Circulating-water utilization system
2 Circulation channel
3 Water consumer
3*a* Residence
3*b* Tenant shop
3*c* Office
4 Discharge channel
6 Supply channel
8 Purifying unit
8*a* Purifying-unit control unit
10 Safety device
12 Drinking-water producing unit
14 Drinking-water supply unit
14*a* Drinking-water feeding channel
14*b* Reservoir tank, drinking-water tank
14*c* Drinking-water channel
16 Tap-water introducing channel
18*c* Daily-life-water amount measuring unit (flow meter)
22 Purified-water supply channel

23 Circulating water shutoff valve
23*a* Circulating water shutoff valve control unit
24 Second gate valve
24*a* Second gate-valve control unit
25 Abnormality-time supply channel
26 Outage detecting unit
28 Tap-water monitoring unit
30 Tap-water shutoff valve
30*a* Tap-water shutoff valve control unit
32 Circulating-water monitoring unit
32*a* Informing unit
33 Wastewater monitoring unit
34 Gray-water supply channel
35 Gate valve
35*a* Gate-valve control unit
36 Treatment-vessel monitoring unit
38 Circulating-water storage tank
38*a* Storage-amount measuring unit
39 Demand predicting part
42 Wastewater storage tank
45 Switching unit
45*a* Switching-unit control unit

The invention claimed is:

1. A circulating-water utilization system comprising:

a circulation channel through which circulating water flows;

a discharge channel through which wastewater discharged from a water consumer is discharged to the circulation channel, the water consumer being composed of a plurality of water consuming members including at least one of a residence, a tenant shop, or an office which uses the circulating water flowing through the circulation channel;

a purifying unit configured to purify the circulating water containing the wastewater flowing through the circulation channel, the purifying unit comprising a plurality of treatment vessels connected to one another;

a supply channel configured to supply the circulating water purified by the purifying unit to the water consumer; and a safety device comprising at least one of a circulating-water monitoring unit configured to monitor a water quality of the circulating water purified by the purifying unit, or a treatment-vessel monitoring unit configured to detect abnormality of the treatment vessels constituting the purifying unit, wherein the safety unit further comprises:

a circulating-water shutoff valve disposed in the supply channel and configured to be capable of shutting off supply of the circulating water purified by the purifying unit to the water consumer;

a circulating-water shutoff valve control unit capable of controlling operation of the circulating-water shutoff valve;

an abnormality-time supply channel connecting a waterworks system and the supply channel at a downstream side of the circulating-water shutoff valve;

a gate valve disposed in the abnormality-time supply channel and configured to open and close the abnormality-time supply channel; and a gate-valve control unit capable of controlling the gate valve to open and close, and wherein the circulating-water shutoff valve control unit is configured to start operation of the circulating-water shutoff valve to shut off supply of the circulating water to the water consumer, and the gate-valve control unit is configured to open the gate valve to supply the supply channel with tap water from the waterworks system, if the circulating-water monitoring unit detects deterioration of the water quality of the circulating water purified by the purifying unit to below a predetermined water quality.

2. The circulating-water utilization system according to claim 1, wherein the safety device further comprises a wastewater monitoring unit configured to monitor a water quality of the wastewater flowing through the discharge channel, and a plurality of wastewater storage tanks each of which is capable of storing a predetermined amount of the wastewater discharged from corresponding one of the plurality of water consuming members constituting the water consumer, wherein the circulating-water shutoff valve control unit is configured to start operation of the circulating-water shutoff valve to shut off supply of the circulating water to the water consumer, and the gate-valve control unit is configured to open the gate valve to supply the supply channel with tap water from the waterworks system, if the wastewater monitoring unit detects contamination of the wastewater flowing through the discharge channel with a predetermined amount or more of a predetermined harmful substance.

3. The circulating-water utilization system according to claim 1, further comprising a circulating-water storage tank capable of storing the circulating water purified by the purifying unit.

4. The circulating-water utilization system according to claim 2, further comprising a circulating-water storage tank capable of storing the circulating water purified by the purifying unit.

5. A circulating-water utilization system comprising:

a circulation channel through which circulating water flows;

a discharge channel through which wastewater discharged from a water consumer is discharged to the circulation channel, the water consumer being composed of a plurality of water consuming members including at least one of a residence, a tenant shop, or an office which uses the circulating water flowing through the circulation channel;

a purifying unit configured to purify the circulating water containing the wastewater flowing through the circulation channel, the purifying unit comprising a plurality of treatment vessels connected to one another;

a supply channel configured to supply the circulating water purified by the purifying unit to the water consumer; and a safety device comprising at least one of a circulating-water monitoring unit configured to monitor a water quality of the circulating water purified by the purifying unit, or a treatment-vessel monitoring unit configured to detect abnormality of the treatment vessels constituting the purifying unit, wherein the purifying unit comprises a plurality of treatment-vessel rows of the plurality of treatment vessels connected in series, each of the treatment vessels comprising a container which houses a treatment device configured to perform a treatment step which constitutes a series of purifying step for purifying the wastewater, wherein the safety device further comprises a switching unit capable of switching a flow of the circulating water so that the circulating water containing the wastewater flows through an optional treatment-vessel row of the plurality of treatment-vessel rows, and a switching-unit control unit capable of controlling the switching unit, and wherein the switching-unit control unit is configured to control the switching unit so that the circulating water does not flow through the treatment-vessel row including the treatment vessel in which abnormality is detected, if the treatment-vessel monitoring unit detects abnormality of the treatment vessel.

6. The circulating-water utilization system according to claim 5, further comprising a circulating-water storage tank capable of storing the circulating water purified by the purifying unit.

7. A circulating-water utilization system comprising:

a circulation channel through which circulating water flows;

a discharge channel through which wastewater discharged from a water consumer is discharged to the circulation channel, the water consumer being composed of a plurality of water consuming members including at least one of a residence, a tenant shop, or an office which uses the circulating water flowing through the circulation channel;

a purifying unit configured to purify the circulating water containing the wastewater flowing through the circulation channel, the purifying unit comprising a plurality of treatment vessels connected to one another;

a supply channel configured to supply the circulating water purified by the purifying unit to the water consumer;

a drinking-water producing unit configured to produce drinking water for the water consumer by purifying tap water taken in from a waterworks system;

a purified-water supply channel for supplying the drinking-water producing unit with the circulating water purified by the purifying unit, the purified-water supply channel connecting the circulation channel and the drinking-water producing unit; and a safety device comprising at least one of a circulating-water monitoring unit configured to monitor a water quality of the circulating water purified by the purifying unit, or a treatment-vessel monitoring unit configured to detect abnormality of the treatment vessels constituting the purifying unit, wherein the safety device further includes a gate valve configured to open and close the purified-water supply channel, an outage detecting unit capable of detecting outage of the waterworks system, and a gate-valve control unit configured to control the gate valve to open and close, and wherein the gate-valve control unit is configured to open the gate valve to supply the drinking-water producing unit with the circulating water purified by the purifying unit, if the outage detecting unit detects outage of the waterworks system.

8. The circulating-water utilization system according to claim 7, further comprising a circulating-water storage tank capable of storing the circulating water purified by the purifying unit.

9. A circulating-water utilization system comprising:

a circulation channel through which circulating water flows;

a discharge channel through which wastewater discharged from a water consumer is discharged to the circulation channel, the water consumer being composed of a plurality of water consuming members including at least one of a residence, a tenant shop, or an office which uses the circulating water flowing through the circulation channel;

a purifying unit configured to purify the circulating water containing the wastewater flowing through the circulation channel, the purifying unit comprising a plurality of treatment vessels connected to one another;

a supply channel configured to supply the circulating water purified by the purifying unit to the water consumer;

a drinking-water producing unit configured to produce drinking water for the water consumer by purifying tap water taken in from a waterworks system;

a purified-water supply channel for supplying the drinking-water producing unit with the circulating water purified by the purifying unit, the purified-water supply channel connecting the circulation channel and the drinking-water producing unit; and a safety device comprising at least one of a circulating-water monitoring unit configured to monitor a water quality of the circulating water purified by the purifying unit, or a treatment-vessel monitoring unit configured to detect abnormality of the treatment vessels constituting the purifying unit, wherein the safety device further includes a gate valve configured to open and close the purified-water supply channel, a gate-valve control unit configured to control the gate valve to open and close, a tap-water monitoring unit configured to monitor a water quality of the tap water, a tap-water shutoff valve capable of shutting off intake of the tap water, and a tap-water shutoff valve control unit configured to control operation of the tap-water shutoff valve, and wherein the gate-valve control unit is configured to open the gate valve to supply the drinking-water producing unit with the circulating water purified by the purifying unit, and the shutoff-valve control unit is configured to start operation of the tap-water shutoff valve to shutoff intake of the tap water, if the tap-water monitoring unit detects deterioration of the water quality of the tap water to below a predetermined water quality.

10. The circulating-water utilization system according to claim 9, further comprising a circulating-water storage tank capable of storing the circulating water purified by the purifying unit.

* * * * *